US011041648B2

(12) United States Patent
Rigg et al.

(10) Patent No.: US 11,041,648 B2
(45) Date of Patent: Jun. 22, 2021

(54) HEATING, VENTILATION, AND/OR AIR CONDITIONING SYSTEM FAULT LOG MANAGEMENT SYSTEMS

(71) Applicant: Johnson Controls Technology Company, Auburn Hills, MI (US)

(72) Inventors: Brian D. Rigg, Douglass, KS (US); Shaun B. Atchison, Wichita, KS (US)

(73) Assignee: Johnson Controls Technology Company, Auburn Hills, MI (US)

( * ) Notice: Subject to any disclaimer, the term of this patent is extended or adjusted under 35 U.S.C. 154(b) by 133 days.

(21) Appl. No.: 16/144,069

(22) Filed: Sep. 27, 2018

(65) Prior Publication Data

US 2019/0353372 A1 Nov. 21, 2019

Related U.S. Application Data

(60) Provisional application No. 62/674,448, filed on May 21, 2018.

(51) Int. Cl.

| | |
|---|---|
| ***F24F 11/38*** | (2018.01) |
| ***F24F 11/88*** | (2018.01) |
| ***F24F 11/64*** | (2018.01) |
| ***F24F 11/76*** | (2018.01) |

(Continued)

(52) U.S. Cl.

CPC ..... *F24F 11/38* (2018.01); *F24F 11/523* (2018.01); *F24F 11/61* (2018.01); *F24F 11/64* (2018.01); *F24F 11/76* (2018.01); *F24F 11/88* (2018.01)

(58) Field of Classification Search

CPC ..... F24F 11/523; F24F 11/61; F24F 11/76; F24F 11/88; F24F 11/74; F24F 11/38; F24F 11/64

See application file for complete search history.

(56) References Cited

U.S. PATENT DOCUMENTS 4,663,725 A * 5/1987 Truckenbrod ..... B60H 1/00014 165/255
5,751,572 A 5/1998 Maciulewicz
5,927,398 A 7/1999 Maciulewicz (Continued)

FOREIGN PATENT DOCUMENTS

JP H01260249 A * 10/1989
JP 2003065598 A * 3/2003

(Continued)

OTHER PUBLICATIONS

Ishikawa et al., Failure Diagnosing Device for Air Conditioner, May 6, 2010, JP2010101568A, Whole Document (Year: 2010).*

(Continued)

*Primary Examiner* — Larry L Furdge
(74) *Attorney, Agent, or Firm* — Fletcher Yoder, P.C.

(57) ABSTRACT

A control system for a heating, ventilation, and/or air conditioning (HVAC) system includes control circuitry having a storage device and a microcontroller. The storage device is configured to store faults. The microcontroller is configured to monitor for a condition of the HVAC system associated with a fault, store a fault in the storage device when the condition is detected, identify whether a duration of time that the fault has been stored in the storage device exceeds a threshold time period, and clear the fault from the storage device when the duration exceeds the threshold time period.

22 Claims, 11 Drawing Sheets

(51) Int. Cl.
*F24F 11/61* (2018.01)
*F24F 11/523* (2018.01)

(56) References Cited

U.S. PATENT DOCUMENTS 6,017,192 A * 1/2000 Clack ..... F04B 49/02 417/13
6,075,937 A 6/2000 Scalzi et al.
7,294,026 B1 11/2007 Donnell et al.
7,781,910 B2 8/2010 Donnell et al.
7,814,369 B2 10/2010 McCroskey et al.
7,877,636 B2 1/2011 Kim et al.
8,091,373 B2 1/2012 Hugghins et al.
8,141,106 B2 3/2012 Labar
8,219,660 B2 7/2012 McCoy et al.
8,417,478 B2 4/2013 Gintis et al.
8,504,174 B2 8/2013 Rahme et al.
8,516,118 B2 8/2013 Saint Clair et al.
8,548,630 B2 10/2013 Grohman
8,861,537 B1 10/2014 Braithwaite et al.
9,328,727 B2 * 5/2016 Koehl ..... G05B 15/02
9,760,501 B2 9/2017 Logue
10,009,979 B2 6/2018 Weber et al.
2002/0082746 A1 6/2002 Schubring et al.
2004/0059815 A1 3/2004 Buckingham et al.
2008/0128523 A1 * 6/2008 Hoglund ..... G06F 3/0488 236/51
2009/0119686 A1 5/2009 Monroe
2009/0125882 A1 5/2009 Frigo et al.
2009/0321039 A1 * 12/2009 Therrien ..... E04H 1/1238 165/11.1
2011/0046790 A1 * 2/2011 Miller ..... F24F 11/46 700/276
2012/0022700 A1 * 1/2012 Drees ..... G06Q 30/0283 700/276
2012/0075754 A1 * 3/2012 Jayanth ..... H02H 7/0852 361/26
2014/0330437 A1 * 11/2014 Kuroiwa ..... H04L 43/0817 700/275
2015/0309949 A1 10/2015 Bettencourt et al.
2015/0331395 A1 11/2015 Hepperla et al.
2016/0209068 A1 7/2016 Castillo et al.
2016/0217674 A1 7/2016 Stewart et al.
2016/0283432 A1 9/2016 Marinho et al.
2017/0279876 A1 9/2017 Prasad et al.
2018/0039238 A1 * 2/2018 Gartner ..... A61P 3/10
2018/0183882 A1 6/2018 Flynn et al.
2019/0186766 A1 * 6/2019 Maslekar ..... F24F 11/38

FOREIGN PATENT DOCUMENTS

JP 2008267749 A * 11/2008
JP 2010101568 A * 5/2010
WO 2008011498 A2 1/2008
WO 2017062025 A1 4/2017

OTHER PUBLICATIONS

Matsui et al., Remote Control Device for Air Conditioner, Oct. 17, 1989, JPH01260249A, Whole Document (Year: 1989).*
Kamiya et al., Hot Water Supply System, Mar. 5, 2003, JP2003065598A, Whole Document (Year: 2003).*
Obana, Heat Pump Unit and Heat Pump Type Water Heater, Nov. 6, 2008, JJP2008267749A, Whole Document (Year: 2008).*

* cited by examiner

HEATING, VENTILATION, AND/OR AIR CONDITIONING SYSTEM FAULT LOG MANAGEMENT SYSTEMS

CROSS-REFERENCE TO RELATED APPLICATIONS

This application claims priority from and the benefit of U.S. Provisional Application Ser. No. 62/674,448, entitled "HVAC SYSTEM FAULT LOG MANAGEMENT SYSTEMS AND METHODS", filed May 21, 2018, which is herein incorporated by reference in its entirety for all purposes.

BACKGROUND

The present disclosure generally relates to heating, ventilation, and/or air conditioning (HVAC) systems and, more particularly, to control systems that may be implemented in a HVAC system.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

An HVAC system generally includes a control system to control and/or to coordinate operation of devices, such as equipment, machines, and sensors. For example, the control system may communicate sensor data and control commands with devices in the HVAC system. The control system may monitor devices of the HVAC system and store indications of faults within the HVAC system. However, it is now recognized that it may be time consuming and costly to troubleshoot multiple faults.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a control system for a heating, ventilation, and/or air conditioning (HVAC) system includes control circuitry having a storage device and a microcontroller. The storage device is configured to store faults. The microcontroller is configured to monitor for a condition of the HVAC system associated with a fault, store a fault in the storage device when the condition is detected, identify whether a duration of time that the fault has been stored in the storage device exceeds a threshold time period, and clear the fault from the storage device when the duration exceeds the threshold time period.

In another embodiment, a control system for a heating, ventilation, and/or air conditioning (HVAC) system includes control circuitry having a storage device configured to store faults, a display, and a microcontroller. The microcontroller is configured to store a fault in the storage device, display an indication of the fault on the display, identify a threshold time period to retain storage of the fault in the storage device, and clear the fault from the storage device when the duration exceeds the threshold time period. The indication includes a duration of time that the fault has been stored in the storage device.

In another embodiment, a tangible, non-transitory, computer-readable medium, having instructions executable by at least one processor of a control system in a heating, ventilation, and/or air conditioning (HVAC) system that, when executed by the at least one processor, cause the at least one processor to monitor for occurrence of a condition of the HVAC system, and store, upon detecting occurrence of the condition, a fault in a non-volatile memory, wherein the fault provides an indication of the condition. The instructions cause the at least one processor to identify whether a duration of time that the fault has been stored in the non-volatile memory exceeds a defined threshold time period, clear the fault when the duration exceeds the threshold time period.

BRIEF DESCRIPTION OF THE DRAWINGS

Various aspects of the present disclosure may be better understood upon reading the following detailed description and upon reference to the drawings, in which.

DETAILED DESCRIPTION

Figure 1:
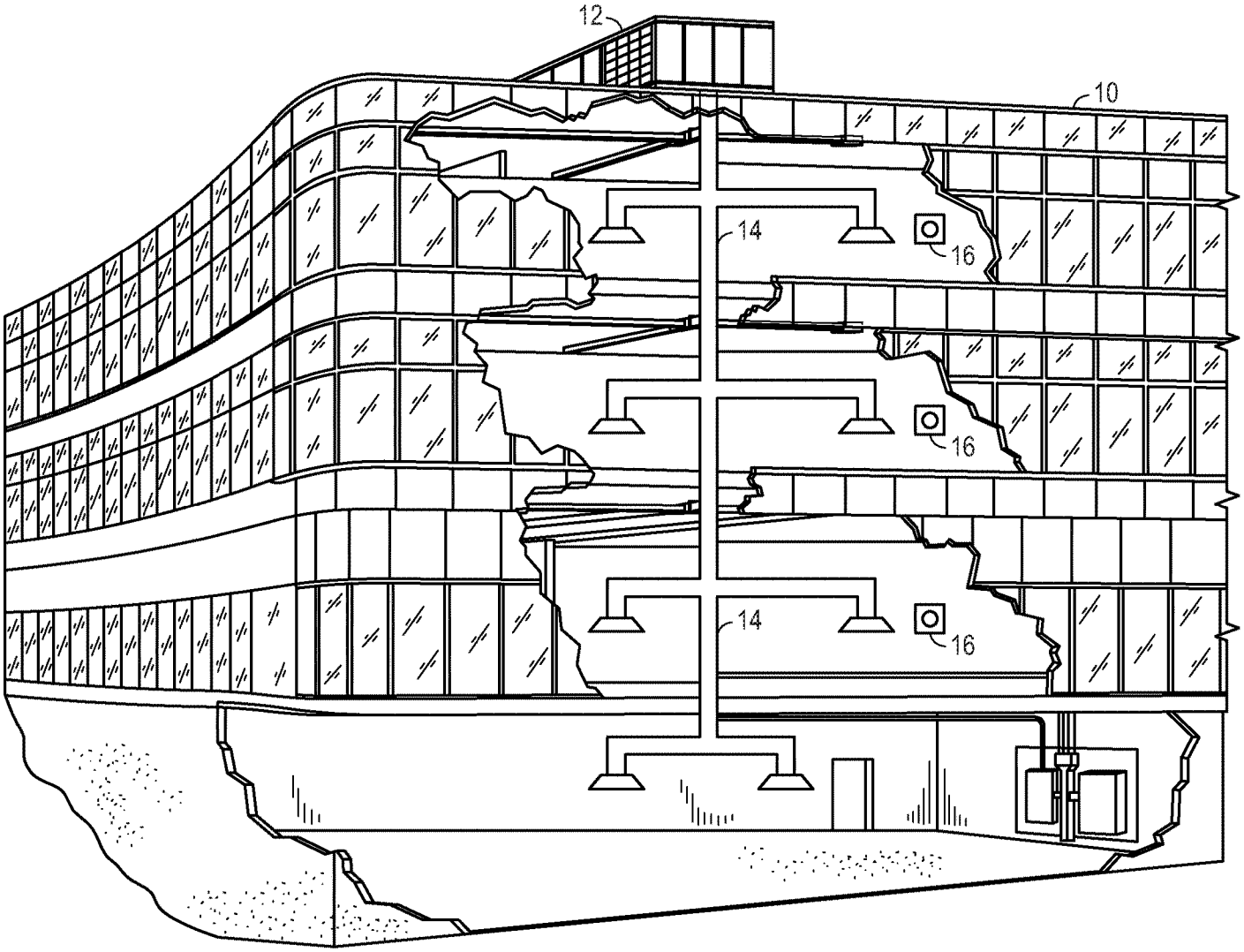
FIG. 1 illustrates a heating, ventilating, and air conditioning (HVAC) system for building environmental management that may employ one or more HVAC units, in accordance with an embodiment of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As will be discussed in further detail below, heating, ventilation, and air conditioning (HVAC) systems often utilize a control system to control the operation of devices or equipment within the HVAC system, for example, implemented via control circuitry. The control circuitry may include one or more control boards or panels. That is, control circuitry may receive input data or signals from one or more devices in the HVAC system, such as an interface device, a thermostat, a sensor, other control circuitry, or any combination thereof. Additionally or alternatively, control circuitry may output control commands or signals that instruct one or more other devices in the HVAC system to perform control actions. For example, a control board may receive a temperature setpoint via a thermostat, compare the temperature setpoint to a temperature measurement received from a sensor, and instruct equipment in the HVAC system to adjust operation when the temperature measurement deviates from the temperature setpoint by more than a threshold amount.

To interface with a device in the HVAC system, the control circuitry may communicatively and/or electrically couple to the device via an input/output (I/O) port. The device may be implemented to communicate via a specific address, where the address for each device may be assigned during manufacturing or during initial installation of the device with the HVAC system. The functionality of legacy devices may decrease over time, or legacy devices may provide anomalous communications. Additionally, or in the alternative, new compatible devices may have improved functionality and/or capabilities relative to legacy devices. Thus, to provide improved functionality of devices of the HVAC system, the control circuitry may store a fault in a memory if legacy devices are present or are referenced within the HVAC system. Furthermore, some devices may be mismatched with the control circuitry or other components of the HVAC system, such that the mismatched devices are incompatible with the control circuitry or HVAC system. In some embodiments, the control circuitry may notify an owner, manager, or installer of an HVAC system of the presence of legacy devices or mismatched devices within the HVAC system. In some embodiments, the control circuitry may notify an owner, manager, or installer of an HVAC system of any communications with references to legacy devices or mismatched devices within the HVAC system. The control circuitry may identify an incompatible device based at least in part on the address of the incompatible device. In some embodiments, the control circuitry may bar or prevent communications with an incompatible device based at least in part on the address of the incompatible device.

Various faults of the HVAC system may occur during installation, maintenance, or operation of the HVAC system. The faults may be stored in a fault register and in non-volatile memory for review by a service technician. The faults may be stored on one or more control circuitry elements of the control system, and may be accessible for review via one or more control circuitry elements. One or more displays of the control system may be utilized to display faults to a technician. The stored faults may include a time stamp, thereby enabling multiple faults to be reviewed based on the timing of the occurrence of each fault. In some embodiments, the oldest faults may be cleared to enable the storage of newer faults if the capacity (e.g., threshold quantity) of the fault register or the memory would otherwise be exceeded in an overflow condition. That is, a memory may have a maximum allowable quantity of faults that may be stored therein, such that an existing fault stored in the memory may be cleared to open space in the memory for a new fault. The stored faults may be automatically cleared from the fault register and/or from memory after a predetermined time period, after a manual input to clear the faults is received by control circuitry of the control system, or any combination thereof. In some embodiments, a power interruption to the control circuitry may reset a duration of time for the fault that is compared with the predetermined time period.

Accordingly, the present disclosure provides techniques to facilitate improving the functionality of a control system, for example, by enabling control circuitry to communicate with compatible devices of the HVAC system and to prevent communications with incompatible devices of the HVAC system. In some embodiments, the control circuitry may include a plurality of compatible addresses for compatible devices with which the control circuitry may communicate, and the control circuitry may prevent or bar communication with devices having addresses that are not in plurality of compatible addresses. In some embodiments, the control circuitry may include a plurality of incompatible addresses for incompatible devices (e.g., legacy devices, mismatched devices) with which the control circuitry does not communicate, and the control circuitry may enable communication with devices having addresses that are not in the plurality of incompatible addresses. More specifically, the control circuitry may identify incompatible devices when the control circuitry is installed or reset with the HVAC system, when the incompatible devices are addressed by communications within the HVAC system, when the incompatible devices are referenced by communications within the HVAC system, or any combination thereof. The incompatible devices excluded from communication on the network of the HVAC system may include HVAC equipment, sensor devices, or system control devices. In this manner, the control circuitry may support the functionality of certain devices of the HVAC system and prohibit communication with other devices that are incompatible with the HVAC system.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
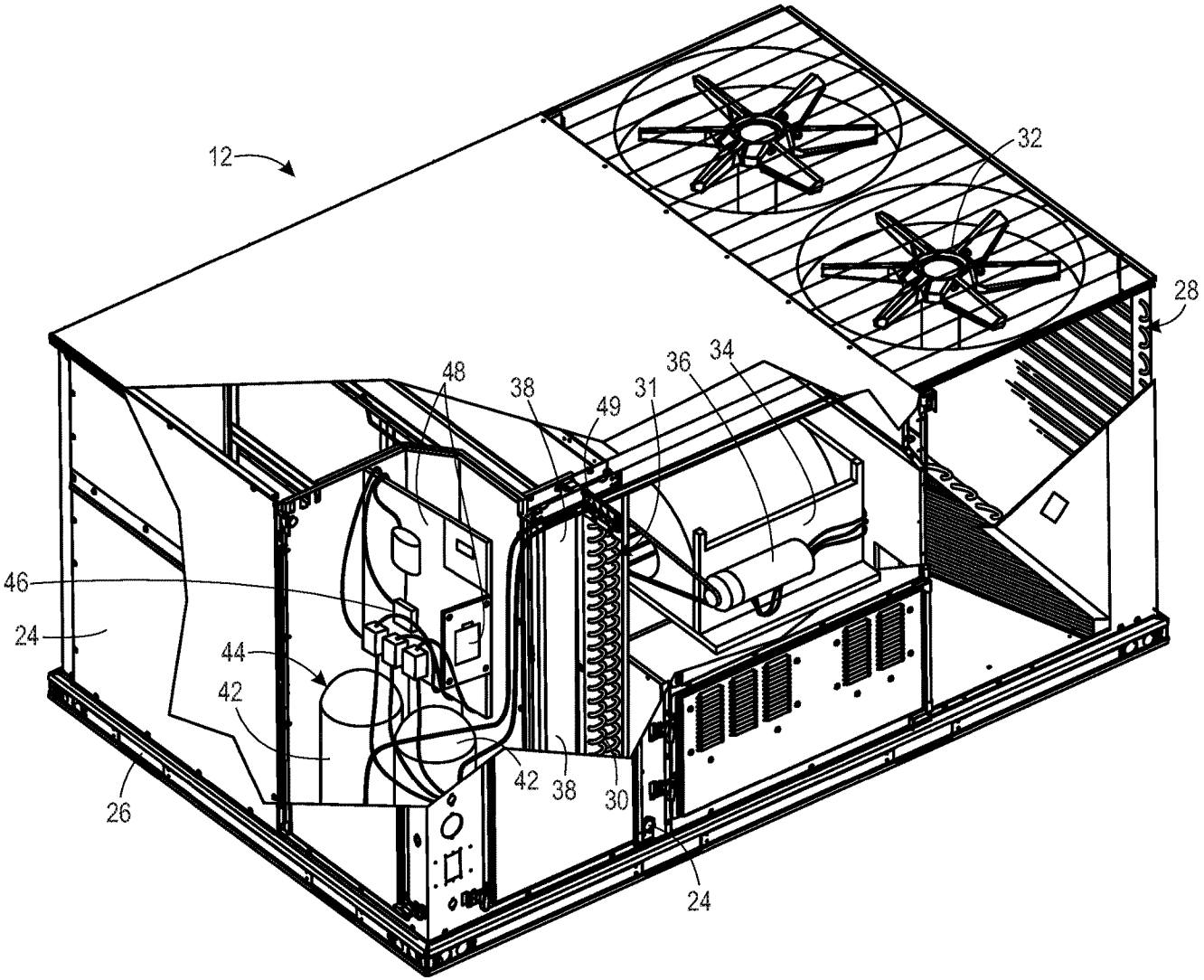
FIG. 2 is a perspective view of a HVAC unit of the HVAC system of FIG. 1, in accordance with an embodiment of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
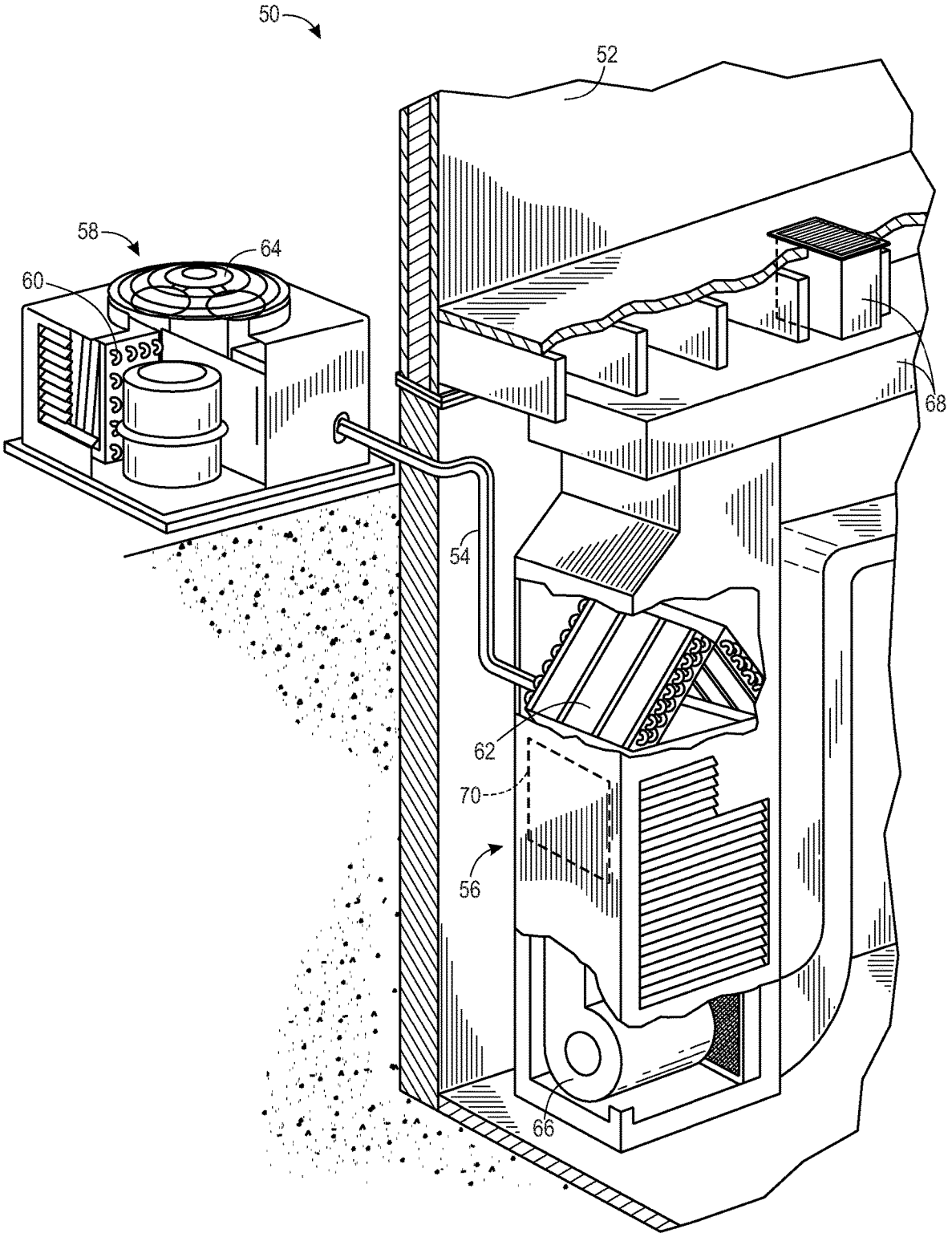
FIG. 3 illustrates a residential heating and cooling system, in accordance with an embodiment of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or a set point plus a small amount, the residential heating and cooling system 50 may become operative to refrigerate additional air for circulation through the residence 52. When the temperature reaches the set point, or a set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
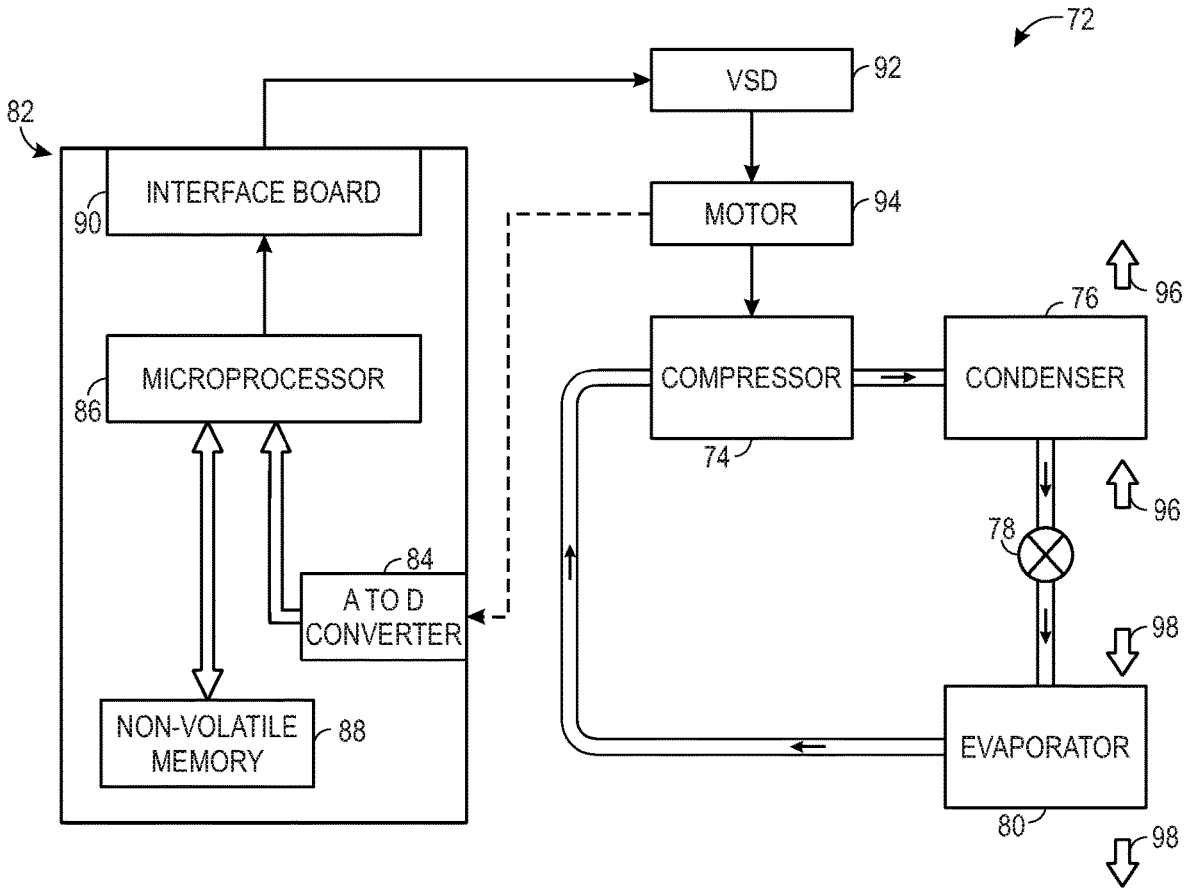
FIG. 4 illustrates a vapor compression system that may be used in the HVAC system of FIG. 1 and in the residential heating and cooling system of FIG. 3, in accordance with an embodiment of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

The description above with reference FIGS. 1-4 is intended to be illustrative of the context of the present disclosure. The techniques of the present disclosure may update features of the description above. In particular, as will be discussed in more detail below, multiple control boards 48, such as control panels 82, may be implemented in the HVAC system, for example, to facilitate improving control granularity and/or to provide hierarchical control.

Figure 5:
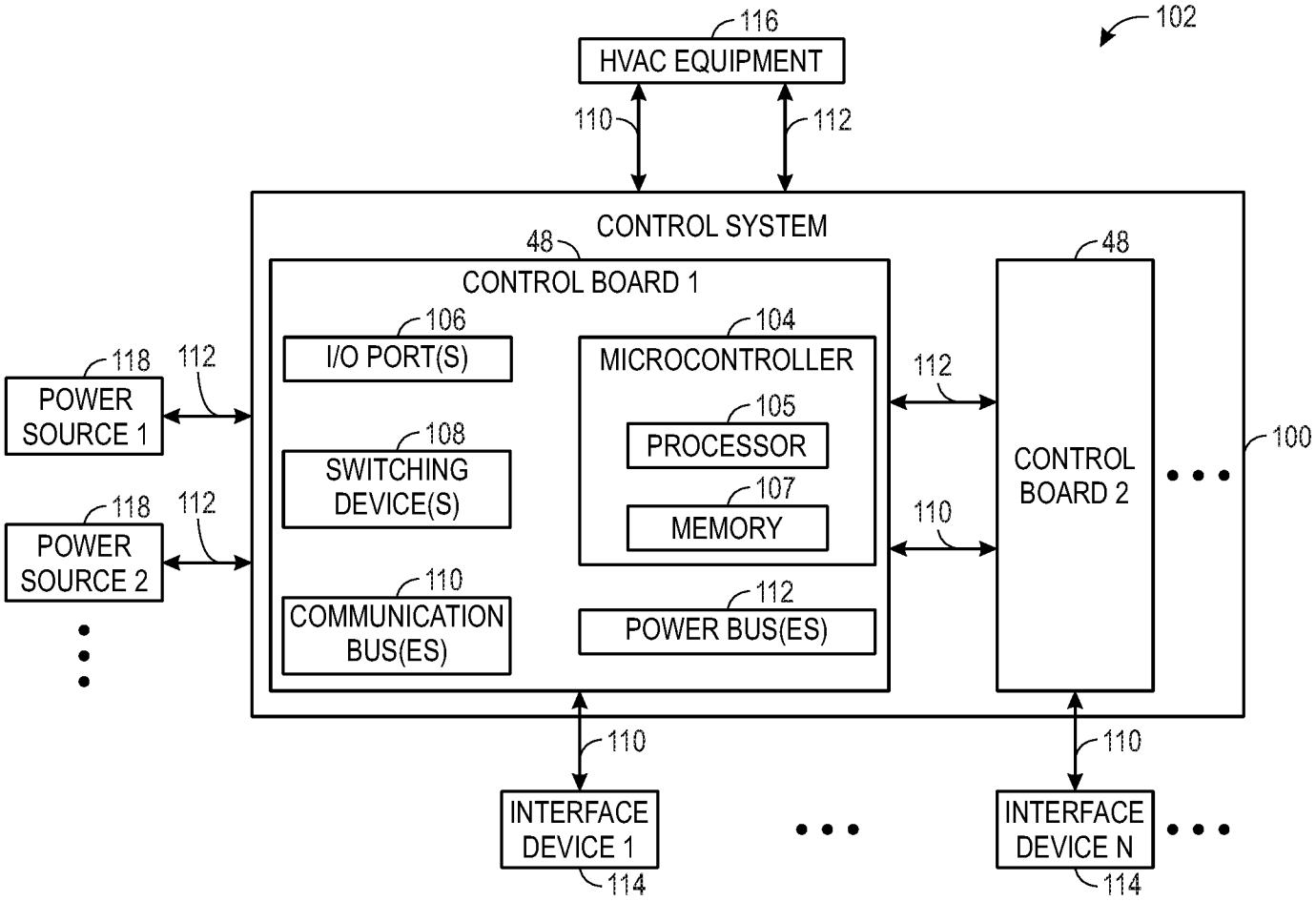
FIG. 5 is a block diagram of a portion of the HVAC system of FIG. 1 including a control system implemented using one or more control boards, in accordance with an embodiment of the present disclosure.

To help illustrate, a control system 100 that includes multiple control circuits 48, which may be used to facilitate controlling operation of equipment in an HVAC system 102, is shown in FIG. 5. Each control circuit 48 may include a microcontroller 104 and one or more input/output (I/O) ports 106, switching devices 108 (e.g., relays), communication buses 110, and power buses 112. The microcontroller 104 may include a processor 105, such as microprocessor 86, and memory 107, such as non-volatile memory 88, to facilitate controlling operation of the HVAC system 102.

For example, the microcontroller 104 may communicate control commands instructing the HVAC equipment 116, such as a VSD 92, to perform a control action, such as adjust speed of motor. In some embodiments, the microcontroller 104 may determine control commands based on user inputs received from an interface device 114 and/or operational parameters, such as speed, temperature, and/or pressure, indicated by the HVAC equipment 116, such as a sensor 142. Further, as described above, the HVAC equipment 116 and the interface devices 114 may each communicate using a communication protocol that may, for example, govern a data transmission rate and/or checksum data of transmitted data. However, at least in some instances, different HVAC equipment 116 and/or different interface devices 114 may be implemented to communicate using different communication protocols that may, for example, govern different data transmission rates and/or different checksum data implementations of transmitted data.

Thus, to facilitate controlling operation of the HVAC system 102, control circuitry 48 may include one or more I/O ports 106 that may enable the control circuitry 48 to communicatively couple to an interface device 114, another control circuit element 48, sensors, and/or HVAC equipment 116 via an external communication bus 110. In some embodiments, an external communication bus 110 may include one or more off-board connections, such as wires and/or cables. Additionally, the I/O ports 106 may communicatively couple to the microcontroller 104 via internal or on-board communication buses 110. In some embodiments, an internal communication bus 110 may include one or more on-board connections, such as PCB traces. In this manner, the communication buses 110 may enable the control circuitry 48 to control operation of a device, such as an interface device 114, another control circuit element 48, and/or HVAC equipment 116.

To facilitate controlling operation of a device, one or more of the I/O ports 106 on the control circuitry 48 may also facilitate conducting electrical power (e.g., 24 VAC) from power sources 118 to the device via power buses 112. For example, the control circuitry 48 may receive electrical power from a power source 118, such as a transformer (e.g., an indoor transformer and/or an outdoor transformer), and/or another control circuit element 48 via external power buses 112 coupled to an I/O port 106. Additionally or alternatively, the control circuitry 48 may receive electrical power from a power source 118 and/or another control circuit element 48 via external power buses 112 coupled to a power source input 130. In some embodiments, an external power bus 112 may include one or more off-board connections. Additionally, the control circuitry 48 may output electrical power to HVAC equipment 116 and/or another control circuit element 48 via additional external power buses 112 coupled to its I/O ports 106. The control circuitry 48 may also route electrical power between its I/O ports 106 and/or between its I/O ports 106 and the power source input 130 via internal power buses 112. In some embodiments, an internal power bus 112 may include one or more on-board connections.

Each of the power sources 118 and/or control circuitry elements 48 coupled to a power source input may provide electrical power with certain power parameters (e.g., voltage, current, phase, and/or the like). Accordingly, in some embodiments, a first power source 118, such as an indoor transformer, may provide 24 VAC electrical power with zero phase-offset, and a second power source 118, such as an outdoor transformer, may provide 24 VAC with a 90 degree phase-offset. Further, in some embodiments, the first power source 118 may provide 24 VAC electrical power with zero phase-offset, and the second power source 118 may provide 24 VAC electrical power with 90 degree phase-offset. As such, the control circuitry 48 may receive electrical power having respective power parameters from a number of power sources 118 and/or control circuitry elements 48.

Further, as the control circuitry 48 may simultaneously receive electrical power from multiple different power sources 118 and/or additional control circuitry elements 48, the control circuitry 48 may use the switching device 108 (e.g., latching device) to electrically isolate the electrical powers supplied by different power sources 118, for example, to facilitate improving communication quality. In particular, when electrical power output from two power sources 118 is out of phase relative to one another, routing the electrical powers through the control circuitry 48 in close proximity or within the same internal buses 112 may result in cross talk and/or phantom voltages. That is, for example, in cases where electrical power of a first power source 118 has a first phase as a power parameter and electrical power of a second power source 118 has a second phase that is different from the first phase as a power parameter, the electrical powers may create undesired effects in certain regions of the control circuitry 48 and/or induce voltages in wires and/or components, which may result in unpredictable behavior in the control circuitry 48 and/or in a device coupled to the control circuitry 48. Accordingly, the switching device 108 may switch between the power buses 112 coupled to the power sources 118 to isolate the electrical powers received from each power source 118 and reduce, thereby reducing likelihood of producing undesired effects (e.g., cross talk, phantom voltages, and/or the like) that may result from competing electrical powers (e.g., electrical powers from different power sources 118) that are not electrically isolated.

By supporting multiple control circuitry elements 48, the responsibilities of the control system 100 may be segregated. That is, master HVAC control circuitry 48 may handle certain responsibilities, such as communicating with a master interface device 114 and HVAC equipment 116 associated with the vapor compression system 72, primary zone control circuitry 48 may handle certain responsibilities, such as communicating with a primary interface device 114 and HVAC equipment 116 associated with a first set of building zones, and secondary zone control circuitry 48 may handle other responsibilities, such as communicating with a secondary interface device 114 and HVAC equipment 116 associated with a second set of building zones. That is, the primary zone control circuitry may control zoning equipment 144 of the HVAC equipment 116, such as the zoning dampers, and the master control circuitry may control the vapor compression system 72 of the HVAC equipment 116. As such, the control system 100 may improve control granularity, as each control circuitry element 48 may handle a dedicated subset of responsibilities instead of all of the responsibilities of the control system 100. Further, the control circuitry elements 48 may communicatively couple to one another so that relevant information regarding related responsibilities and/or tasks may be shared. In some embodiments, the master control circuitry 48 may receive and process a request for a temperature setpoint for a building zone from the interface device 114, and the primary zone control circuitry 48 may use information received from the master control circuitry 48 to control the zoning equipment 144 of the HVAC equipment 116 to approach and/or satisfy the temperature setpoint for the building zone. For example, the primary zone control circuitry 48 may control the positions of one or more dampers associated with the building zone based on the received request for the temperature setpoint for the building zone. Additionally, the primary zone control circuitry may process zone demands for the building zones to determine a building demand, and the master control circuitry may whether to engage heating equipment of the HVAC equipment 116 or to engage cooling equipment of the HVAC equipment 116 based on the building demand. The master control circuitry 48 may process the request to control the HVAC equipment 116 associated with the vapor compression system 72, such as the VSD 92. As such, each control circuitry element 48 may be implemented to handle a different set of responsibilities and to communicate with other control circuitry element 48, as will be described in further detail.

Further, in some embodiments, the control circuitry elements 48 of the control system 100 may be coupled to facilitate implemented a control hierarchy. For example, a master control circuitry 48 may operate as a master to one or more subordinate control circuitry elements 48. In some embodiments, the master control circuitry 48 may handle coordination with and between subordinate control circuitry elements 48. The subordinate control circuitry 48 may receive instructions from the master control circuitry 48 and control a set of devices accordingly. Further, in some embodiments, as will be described in further detail below, the master control circuitry 48 may handle a subset of responsibilities, and the subordinate control circuitry 48 may handle a different subset of responsibilities. In some embodiments, each control circuitry element 48 may dynamically change between operating as master control circuitry 48 or subordinate control circuitry 48.

Figure 6:
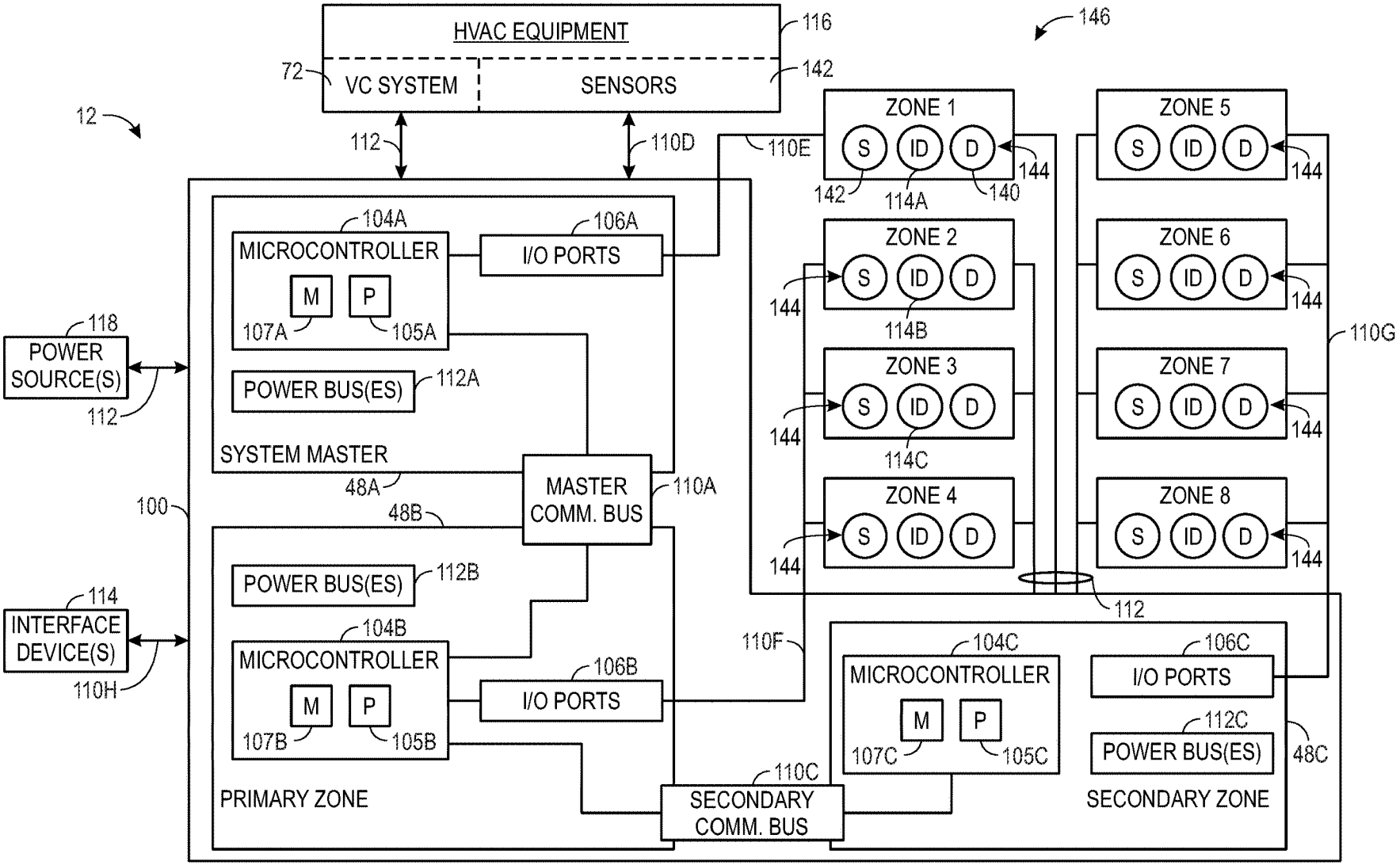
FIG. 6 is a block diagram of the control system of FIG. 5 with a plurality of control boards, in accordance with an embodiment of the present disclosure.

To help illustrate, an example of a control system 100 with multiple control circuitry elements 48 is shown in FIG. 6. In the illustrated embodiment, the control system 100 includes a system master thermostat (e.g., master control board 48A), primary zone control circuitry (e.g., control board 48B), and secondary zone control circuitry (e.g., control board 48C). Each control circuitry element 48 may include a power bus 112 configured to receive and/or transmit power, I/O ports 106 to couple the control circuitry 48 to other components of the HVAC system 12, and a microcontroller 104. The I/O ports 106 may couple the control circuitry 48 to an interface device 114, another control circuit element 48, sensors 142, and/or HVAC equipment 116 via the communication bus 110, or any combination thereof. Depending on the particular type of control circuitry 48, different circuitry arrangements (e.g., different I/O ports 106, microcontrollers 104, and/or other circuitry may be used). For example, the system master thermostat (e.g., master control circuitry 48A), which communicates with control circuitry elements 48 of the HVAC equipment 116, may utilize different circuitry arrangements than zone controller control boards (e.g., primary zone control circuitry 48B and secondary zone control circuitry 48C), which may provide zone control via an interface with the master control circuitry 48A and via zone interface devices (e.g., interface device 114).

Each control circuitry element 48 may have one or more communication buses 110 that facilitate communication with other control circuitry elements 48 of the control system 100. For example, a master communication bus 110A may facilitate communication between the master control circuitry 48A and the primary zone control circuitry 48B. Likewise, a secondary communication bus 110C may facilitate communication between the primary zone control circuitry 48B and the secondary zone control circuitry 48C. One or both of the master communication bus 110A and the secondary communication bus 110C may be RS-485 Modbus protocol communication buses. In some embodiments, the master communication bus 110A may enable the master control circuitry 48A to communicate with one or more zone control circuitry elements 48B, 48C. The secondary communication bus 110C may enable a plurality of zone control circuitry elements 48B, 48C to communicate with one another. In some embodiments, the primary zone control circuitry 48B may be indirectly communicated with the HVAC equipment 116 via the master communication bus 110A and the master control circuitry 48A, which may directly control the vapor compression system 72 of the HVAC equipment 116. It may be appreciated that although FIG. 6 illustrates the communication buses 110 as separate elements of the control circuitry elements 48, some embodiments of the control circuitry 48 may utilize one or more I/O ports 106 of the respective control circuitry elements 48 for the communication bus 110.

As discussed above, each microcontroller 104 may include a processor 105, such as microprocessor 86, and memory 107, such as non-volatile memory 88, to facilitate controlling operation of the HVAC system 102. In some embodiments, the master control circuitry 48A is configured to communicate with the HVAC equipment 116 and the auxiliary equipment and sensors 144 of Zone 1, the secondary zone control circuitry 48C is configured to communicate with the auxiliary equipment and sensors 144 of Zones 5-8, and the primary zone control circuitry 48B is configured to communicate with the auxiliary equipment and sensors 144 of Zones 2-4 as well as facilitate communications among the control circuitry elements 48A, 48B, and 48C of the control system 100. As discussed herein, the term auxiliary equipment and sensors 144 may include zoning control equipment, such as zone dampers for each zone 146.

The master control circuitry 48A may be configured to communicate with devices of the vapor compression system 72 of the HVAC equipment 116 including, but not limited to the VSD 92, the motor 94, the compressor 74, and one or more sensors 142 configured to provide feedback about the operation of devices of the vapor compression system 72. In some embodiments, the master control circuitry 48A may be configured to communicate with auxiliary equipment and sensors 144 of the HVAC equipment 116 such as fans, blowers, zone dampers 140, and sensors 142 of the HVAC system 12. Moreover, the master control circuitry 48A may be configured to communicate with Zone 1 of the building and the corresponding auxiliary equipment and sensors 144 of Zone 1. In some embodiments, the Zone 1 of the building may have a master interface device 114A, such as a thermostat. In some embodiments, the master control circuitry 48 may be part of the master interface device 114A.

The master interface device 114A may be configured to receive inputs to control all or part of the HVAC system 12. That is, the master interface device 114A may be configured to receive inputs to control the HVAC equipment 116 for other zones 146 of the building. In some embodiments, the master interface device 114A may be configured to receive temperature setpoints for one or more zones of the building. Accordingly, the master control circuitry 48A may be configured to communicate the received temperature setpoints for Zones 2-4 to the primary zone control circuitry 48B. Also, temperature setpoints received for Zones 5-8 by the master control circuitry 48A may be communicated to the secondary zone control circuitry 48C via the primary zone control circuitry 48B.

As discussed herein, each zone 146 may have auxiliary equipment and sensors 144, such as zoning equipment. In some embodiments, one or more zones 146 have an interface device 114, such as a component of a control panel screen of an HVAC unit, a zoning controller, or a thermostat. In some embodiments, the interface 114 may be an external device communicatively coupled to the control system 100. For example, the interface device 114 may be a tablet, a mobile device, a laptop computer, a personal computer, a wearable device, and/or the like. It may be appreciated that the interface devices of some zones 146 may facilitate control of the zoning equipment 144 that are only associated with that respective zone 146, and interface devices of certain zones 146 may facilitate control of the zoning equipment 144 associated with that respective zone 146 and one or more other zones 146. For example, a primary zone interface device 114B in Zone 2 may facilitate control of Zones 2-4, and an interface device 114C in Zone 3 may only facilitate control of Zone 3. The zoning equipment 144 of each zone 146 may include, but are not limited to one or more sensors 142, fans, blowers, and zone dampers 140. It should be appreciated that while FIG. 6 illustrates one sensor 142 and one zone damper 140 for each zone 146, zones 146 may include any combination of zoning equipment 144 to facilitate control of a desired temperature, desired humidity, and/or desired air flow in the zone. Moreover, each zone damper 140 may be configured to be controlled to a plurality of positions between an open position characterized by minimal obstruction of an airflow through the zone damper and a closed position characterized by maximum obstruction of the airflow through the zone damper. In some embodiments, the primary zone control circuitry 48B may be configured to directly control the position of each zone damper directly coupled to the primary zone control circuitry 48B, and the primary zone control circuitry 48B may be configured to indirectly control the position of each zone damper directly coupled to other control circuitry elements via zone control signals communicated along the master communication bus 110A or the secondary communication bus 110C.

As noted above, the control circuitry elements 48 may communicatively couple to one another so that relevant information regarding related responsibilities and/or tasks may be shared. Input signals received via an interface device 114 coupled to one control circuitry element 48 may be communicated to the appropriate control circuitry element 48 via the internal communication buses 110, such as the master communication bus 110A and the secondary communication bus 110C. External communication buses 110 may facilitate communications between the control circuitry elements 48 of the control system 100 and devices of the HVAC system 12. For example, the external communication buses 110 may include, but are not limited to, one or more equipment communication buses 110D, one or more master zone communication buses 110E, one or more primary zone communication buses 110F, one or more secondary zone communication buses 110G, and one or more interface device buses 110H. Although illustrated separately in FIG. 5, one or more of the communication buses 110 coupled to each control circuitry element 48 may be the same communication bus in some embodiments. For example, the equipment communication bus 110D and the master zone communication bus 110E may be the same communication bus of the master control circuitry 48A. Additionally, or in the alternative, the primary zone communication bus 110A may couple the primary zone control circuitry 48B with devices of Zones 2-4 and with the master zone control circuitry 48A. Likewise, the secondary zone communication bus 110C may couple the secondary zone control circuitry 48C with devices of Zones 5-8 and with the primary zone control circuitry 48B.

The control system 100 with multiple control circuitry elements 48 may improve control granularity, as each control circuitry element 48 may handle a dedicated subset of responsibilities instead of all of the responsibilities of the control system 100. Further, the control circuitry elements 48 may communicatively couple to one another so that relevant information regarding related responsibilities and/or tasks may be shared. In some embodiments, the master control circuitry 48 may receive and process a request for a temperature setpoint for a building zone from the interface device 114, and the primary zone control circuitry 48 may use information received from the master control circuitry 48 as a zone demand, which may be analyzed with zone demands from other zones to control the zoning equipment 144 of the HVAC equipment 116 to approach and/or satisfy the zone demand for each building zone. The HVAC equipment 116, controlled by the master control circuitry 48A, may supply an airflow of conditioned air to be divided for provision into zone airflows for each zone of the building. The primary zone control circuitry 48 may control the zoning equipment to adjust the zone airflow for each connected zone to approach and/or satisfy the zone demands.

Each zone demand may include a temperature in the zone, a setpoint for the zone, and a zone mode, such as heat, cool, or auto. In some embodiments, a zone demand may be based at least in part on a size of the zone. The primary zone control circuitry 48B may receive the zone demands from interface devices and/or thermostats in each zone. For example, the primary zone control circuitry 48B may receive the zone demands from Zones 2-4 directly from interface devices of Zones 2-4, yet the primary zone control circuitry 48B may receive the zone demands for Zones 1 and 5-8 indirectly from the master control circuitry 48A and the secondary zone control circuitry 48C, respectively.

The primary zone control circuitry 48B may evaluate the plurality of zone demands to determine how to control the positions of zone dampers of each of the zones to distribute the airflow from the HVAC equipment 116 to satisfy the zone demands. For example, if zone demands of different zones are opposite (e.g., heat and cool), then the primary zone control circuitry 48B may determine to satisfy nonzero heating demands before satisfying the cooling demands, unless the cooling demand is currently being satisfied. That is, the primary zone control circuitry 48B may close the zone dampers to reduce or prevent airflow to the zones with cooling demands while the HVAC equipment 116 supplies heated conditioned air to those zones with heating demands, and the primary zone control circuitry 48B may close the zone dampers to reduce or prevent airflow to the zones with heating demands while the HVAC equipment 116 supplies cooled conditioned air to those zones with cooling demands. As discussed above, the primary zone control circuitry 48B may control the zoning equipment (e.g., dampers), and the master control circuitry 48A may control the HVAC equipment 116 that conditions and provides the airflow to be divided among the zones. The primary zone control circuitry 48B may provide instructions to the master control circuitry 48A to control the HVAC equipment 116 to satisfy the demands determined by the primary zone control circuitry 48B.

Figure 7:
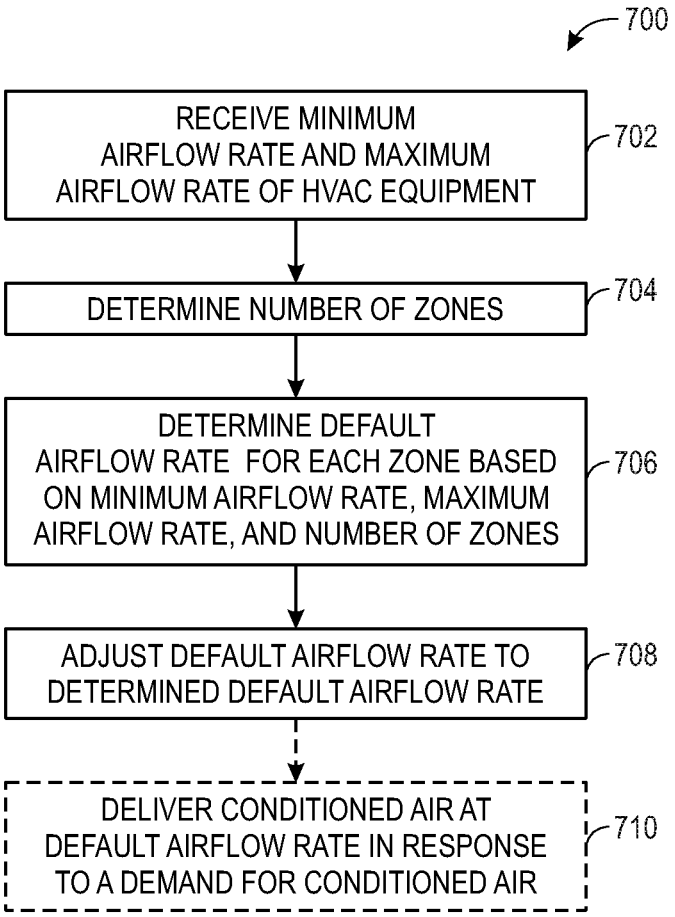
FIG. 7 is a flow diagram of an embodiment of a process for determining a default airflow rate associated with each zone in a zoned HVAC system, in accordance with an embodiment of the present disclosure.

The primary zone control circuitry 48B may control the zone dampers to supply the zone airflows to each zone to satisfy the zone demands. In addition to controlling the zone airflows based on the zone demands, the primary zone control circuitry 48B may control the zone airflows in accordance with thresholds of the HVAC equipment 116 and circulation guidelines. For example, thresholds of a blower of the HVAC equipment 116 may include a maximum airflow output and a minimum airflow. FIG. 7 is a flow diagram of a process 700 for determining the default airflow rate associated with one or more zones serviced by a zoned HVAC system. Steps 702 through 708 of process 700 may be performed by the primary zone control circuitry 48B during an initial configuration of the HVAC system 12 as a zoned system or after resetting an existing configuration of a zoned HVAC system. In step 702, the primary zone control circuitry 48B receives the minimum airflow rate permitted by the HVAC equipment 116 and the maximum airflow rate permitted by the HVAC equipment 116 from the master control circuitry 48A. In some embodiments, the primary zone control circuitry 48B may access the minimum airflow rate permitted by the HVAC equipment 116 and the maximum airflow rate permitted by the HVAC equipment 116 from a memory device of the control system 100. The primary zone control circuitry 48B may receive identification data associated with the HVAC equipment 116 from the master control circuitry 48A. The identification data may include a blower profile that provides the primary zone control circuitry 48B with the maximum airflow rate permitted by a blower of the HVAC equipment 116 and the minimum airflow rate permitted by the blower of the HVAC equipment 116. In some embodiments, the identification data may include specification data of more than one component of the HVAC equipment 116. For example, the identification data may include specification data associated with a blower of the HVAC unit, the fans of the HVAC unit, the dampers of the zoned HVAC system, and/or the ductwork of the zoned HVAC system. The specification data of each component of the HVAC equipment 116 provides the primary zone control circuitry 48B with the maximum airflow rate permitted by each component and/or the minimum airflow permitted by each component of the HVAC equipment 116.

In step 704, the primary zone control circuitry 48B determines the number of zones serviced by the zoned HVAC system. In some embodiments, the primary zone control circuitry 48B may receive data that contains the number of zones from another control circuit element 48, an interface device 114 or an external device such as a mobile device, a tablet, or other electronic device employed by a homeowner or an installer, and/or a network or the internet. In some embodiments, the primary zone control circuitry 48B may access this data from a memory device of the control system 100. The number of zones in the zoned HVAC system may include one zone, two zones, three zones, four zones, five zones, six zones, seven zone, eight zones, or more zones.

In step 706, the primary zone control circuitry 48B determines the default airflow rate for each zone serviced by the HVAC system based on the minimum airflow rate permitted by the HVAC equipment 116, the maximum airflow rate permitted by the HVAC equipment 116, and the number of zones serviced by the HVAC system. In step 708, the primary zone control circuitry 48B then adjusts the default airflow rate to the default airflow rate calculated in step 706. In some embodiments, the default airflow rate may apply to all zones serviced by the HVAC system. In other words, the default airflow rate may be the same for all zones. In some embodiments, the primary zone control circuitry 48B may adjust a separate default airflow rate for each zone serviced by the HVAC system. In optional step 710, the HVAC system may deliver conditioned air at the default airflow rate to one or more zones in response to a demand for conditioned air received by the primary zone control circuitry 48B. For example, after configuration of the primary zone control circuitry 48B and the HVAC system is complete, the primary zone control circuitry 48B may receive a zone demand to adjust the temperature of a zone via a thermostat in the zone. The primary zone control circuitry 48B may then control zoning equipment 144 of the respective zone to deliver conditioned air to the zone at the default airflow rate.

Figure 8:
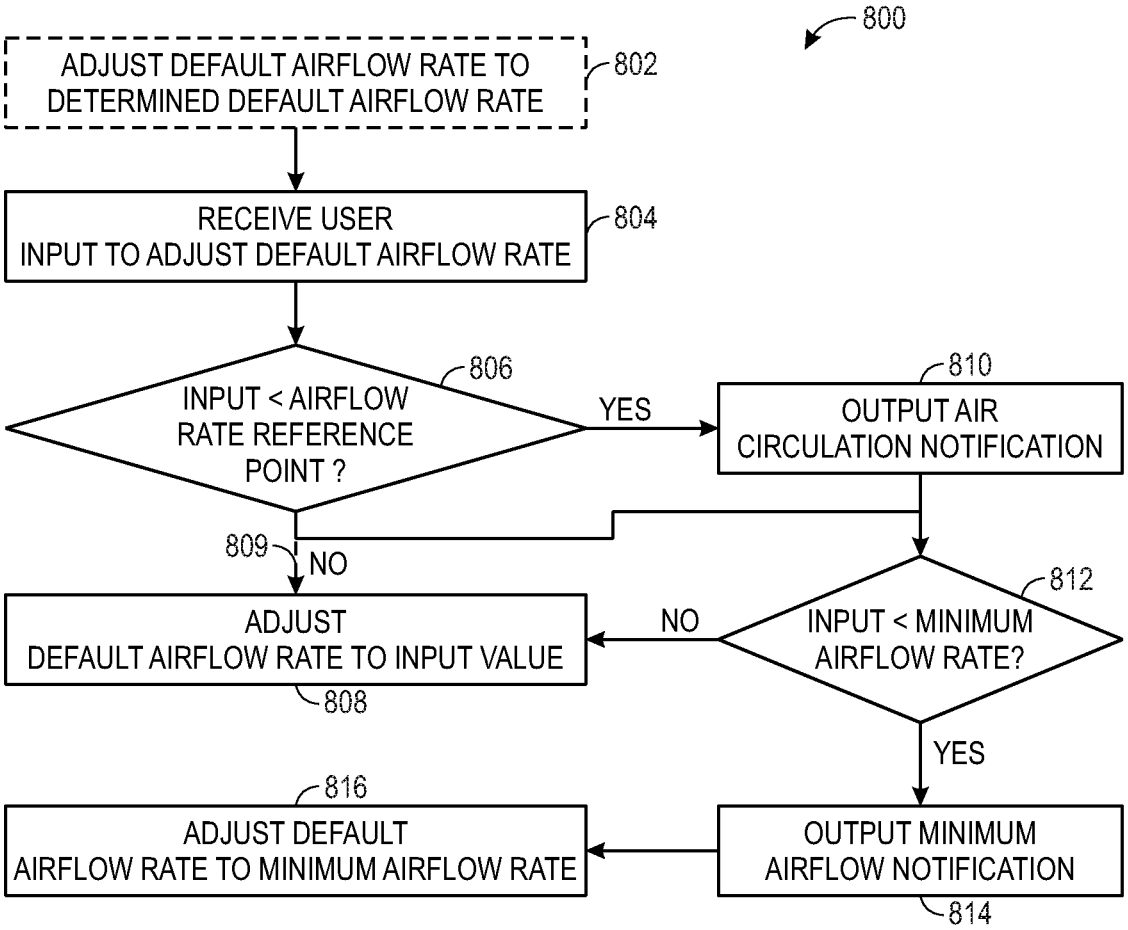
FIG. 8 is a flow diagram of an embodiment of a process for adjusting a default airflow rate in a zoned HVAC system in response to a user input, in accordance with an embodiment of the present disclosure.

FIG. 8 is a flow diagram of a process 800 for adjusting the default airflow rate of a zoned HVAC system in response to zone demands for a customized airflow rate. In some embodiments, the default airflow rate may be automatically calculated based on certain HVAC system parameters, as described above with regard to FIG. 7. In some embodiments, the default airflow rate may be pre-configured by the manufacturers of the HVAC equipment 116 and/or the primary zone control circuitry 48B. Steps 802 through 816 of process 800 may be performed by the primary zone control circuitry 48B during an initial configuration of the HVAC system as a zoned system or after resetting an existing configuration of a zoned HVAC system. As described above with regard to step 708 in FIG. 7, the primary zone control circuitry 48B is configured to adjust the default airflow rate to the calculated default airflow rate for each zone based on the minimum airflow rate permitted by the HVAC equipment, the maximum airflow rate permitted by the HVAC equipment, and the number of zones serviced by the zoned HVAC system in optional step 802. In step 804, the primary zone control circuitry 48B receives a user input to adjust the default airflow rate of the HVAC system to a customized airflow rate. In some embodiments, the primary zone control circuitry 48B may receive a user input through physical buttons, other physical input devices, or a touch screen of an interface device.

In determination step 806, the primary zone control circuitry 48B compares the customized airflow rate associated with the user input to a pre-determined airflow rate reference point. As described herein, the pre-determined airflow rate reference point may be associated with a minimum desired or preferred airflow rate to enable sufficient, adequate, or desired air circulation within a space, such as a zone, conditioned by the HVAC system. For example, the pre-determined airflow rate reference point may be 400 CFM or any other suitable airflow rate. If the primary zone control circuitry 48B determines that the customized airflow rate is greater than or equal to the pre-determined airflow rate reference point, the process 800 may continue to determination step 812, as described below. However, in certain embodiments, if the primary zone control circuitry 48B determines that the customized airflow rate is greater than or equal to the pre-determined airflow rate reference point, the primary zone control circuitry 48B may adjust the default airflow rate to be the customized airflow rate, as indicated by dashed line 809 to step 808, and the process 800 may end without proceeding to step 812. For example, the pre-determined airflow rate reference point may have a value greater than or equal to the minimum airflow rate permitted by the HVAC equipment. In such cases, the primary zone control circuitry 48B may adjust the default airflow rate to be the customized airflow rate without comparing the customized airflow rate to the minimum airflow rate permitted by the HVAC equipment 116.

If the primary zone control circuitry 48B determines in step 806 that the customized airflow rate is less than the pre-determined airflow rate reference point, such as 400 CFM, an air circulation notification may be provided to the user. As such, in step 810, upon a determination that the customized airflow rate is less than the pre-determined airflow rate reference point, the primary zone control circuitry 48B provides a notification to the user that adjustment of the default airflow rate to the customized airflow rate may result in reduced air circulation within the selected zone. In some embodiments, the user may choose to discard the customized airflow rate in response to the air circulation notification and select a different customized airflow rate above the pre-determined airflow rate reference point, and the process 800 may continue to determination step 812 as described below.

If the customized airflow rate input by the user is less than the pre-determined airflow rate reference point, the user, such as an installer, may elect to proceed with the customized airflow rate after the notification related to air circulation is communicated to the user, and the process 800 may continue to determination step 812 as described below. For example, the user or installer may determine that the amount of air circulation associated with the pre-determined airflow rate reference point is not demanded and/or desired for a particular zone or zones.

In determination step 812, the primary zone control circuitry 48B is configured to compare the customized airflow rate to the minimum airflow rate permitted by the HVAC equipment 116. In some embodiments, the customized airflow rate is the customized airflow rate selected by the user in response to the air circulation notification, as described above. Upon a determination that the customized airflow rate is greater than or equal to the minimum airflow rate, the primary zone control circuitry 48B may adjust the default airflow rate to the customized airflow rate, as indicated in step 808, and the process 800 may end.

However, if the primary zone control circuitry 48B determines that the customized airflow rate is less than the minimum airflow rate permitted by the HVAC equipment 116, the primary zone control circuitry 48B may provide a notification that the customized airflow rate is less than the minimum airflow rate permitted by the HVAC equipment 116. Thereafter, as indicated in step 816, the primary zone control circuitry 48B is configured to adjust the default airflow rate to the minimum airflow rate permitted by the HVAC equipment 116 even though the customized airflow rate input by the user is less than the minimum airflow rate permitted by the HVAC equipment 116. In such a circumstance, any excess airflow beyond the customized airflow rate input by the user may still be supplied to the particular zone being configured instead of bled off into an adjacent zone.

In some embodiments, additional customization of the default airflow rate configuration may be enabled. For example, the user may choose to discard the customized airflow rate in response to the minimum airflow notification provided to the user in step 814 and may select a default airflow rate greater than or equal to the minimum airflow rate permitted by the HVAC equipment 116. As such, the primary zone control circuitry 48B may be configured to adjust the default airflow rate to the new selected default airflow rate that is greater than or equal to the minimum airflow rate permitted by the HVAC equipment 116.

In some embodiments, the user may elect to proceed with the customized airflow rate that is less than the minimum airflow rate permitted by the HVAC equipment 116 in response to the minimum airflow notification provided to the user in step 814. For example, the user or the installer may determine that the amount of air circulation associated with the minimum permitted airflow rate is not demanded/desired by a particular zone and that any resulting effects to system performance and efficiency are permissible. As such, in step 816, the primary zone control circuitry 48B may still be configured to adjust the default airflow rate to be the minimum airflow rate permitted by the HVAC equipment 116, but any airflow in excess of the customized airflow rate may be bled into adjacent zones, as the HVAC equipment 116 may be unable to provide an airflow rate less than the minimum permitted airflow rate of the HVAC equipment 116.

Although FIG. 8 illustrates steps 806 through 814 in a specific order, the order of steps 806 through 814 may be in any suitable order for the primary zone control circuitry 48B to determine whether to adjust the default airflow rate to the customized airflow rate and to provide one or more notifications as described herein. For example, the primary zone control circuitry 48B may perform determination steps 806 and 812 simultaneously or in an order other than described herein, and/or the primary zone control circuitry 48B may perform steps 810 and 814 simultaneously or in an order other than described herein.

Although the preceding descriptions of processes 700, 800 are described in a particular order, which represents a particular embodiment, it should be noted that the processes 700, 800 may be performed in any suitable order. Moreover, embodiments of the processes 700, 800 may omit process blocks and/or include suitable additional process blocks. Additionally, while an HVAC system featuring a plurality of zones in a zoning layout is described above, in some embodiments, the primary zone control circuitry 48B may be configured to determine the default airflow rate and adjust the default airflow rate to a customized airflow rate for a non-zoned HVAC system. In such embodiments, the primary zone control circuitry 48B may generally follow processes 700, 800 to determine the default airflow rate and adjust the default airflow rate to a customized airflow rate of a non-zoned HVAC system.

Signals may be communicated over the communication buses 110 utilizing a communications protocol with addresses and other information, such as a Modbus protocol. Each device of the HVAC system 12 that communicates with a control circuitry element 48 via a communication bus 110 may have a respective address, and each control circuitry element 48 may have a respective address. Each device may respond to signals on the communication bus 110 that contain the address of the respective device, and ignore signals with other addresses. Signals communicated along the communication buses 110 may include the address for the respective device and other information, such as function codes (e.g., read, write), register addresses, register values, other communicated data, and checksum data.

As discussed herein, a microcontroller 104 may transmit signals to devices with a compatible address on a communication bus 110. That is, the microcontroller 104 may enable the communication bus to transmit signals with addresses corresponding to a compatible address for the communication bus 110. Also, a microcontroller (e.g., microcontroller 104A, 104B, and/or 104C) may bar transmission of a signal with an incompatible address along the respective communication bus 110, or the microcontroller (e.g., microcontroller 104A, 104B, and/or 104C) may cause the signal with the incompatible address to be ignored by subsequent microcontrollers that receive the signal. In some embodiments, the microcontroller (e.g., microcontroller 104A, 104B, and/or 104C) may transmit control signals to reverse any changes caused by the signal with the incompatible address.

Properly addressed signals among the devices of the HVAC system 12 may improve the reliability and consistency of the behavior of the HVAC system 12. For example, the master control circuitry 48A may have access to different resources such that the master control circuitry 48A may process signals differently than the primary zone control circuitry 48B or the secondary zone control circuitry 48C. Moreover, incompatible devices, such as legacy devices and/or mismatched devices by another manufacturer, may be problematic, causing data processing and/or timing errors, such that signals are not processed properly and/or devices do not respond in a desired manner. A device of the HVAC system 12 that is compatible with the HVAC system 12 may provide different control options and/or may respond differently to a set of instructions than incompatible devices. That is, legacy devices or mismatched devices may be incompatible with the control system 100. Accordingly, properly addressed signals for the master control circuitry 48A may be handled by the master control circuitry 48A to have the desired effect, yet the same signals improperly addressed to another control circuit element may result in no action, an error, or undesired action by the other control circuitry elements.

Figure 9:
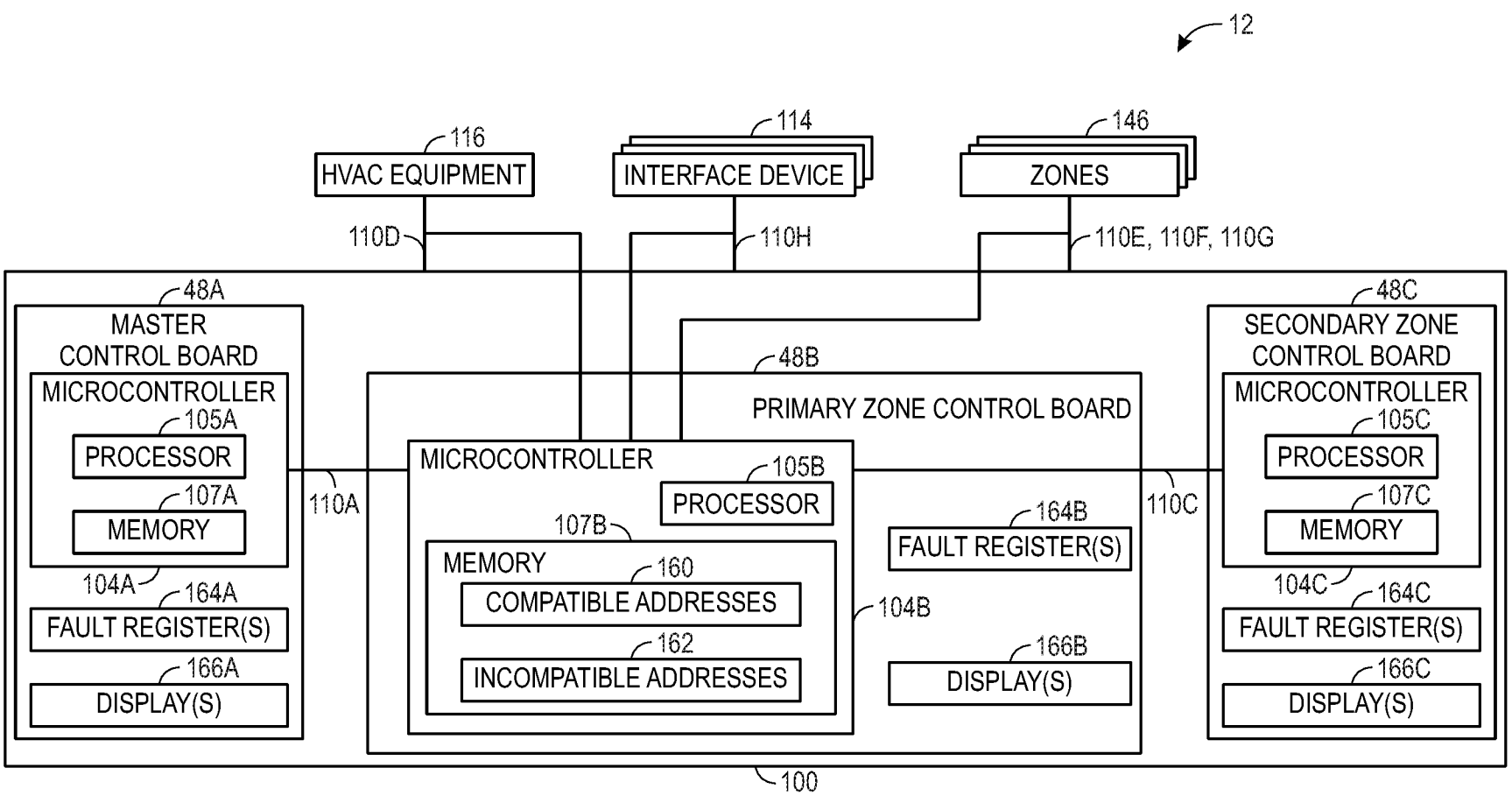
FIG. 9 is a block diagram of an embodiment of control circuitry configured to monitor communication buses of the control system of FIG. 5, in accordance with an embodiment of the present disclosure.

FIG. 9 illustrates an embodiment of the control system 100 of the HVAC system 12 with the primary zone control circuitry 48B configured to monitor communications on the one or more communication buses 110. To reduce or eliminate improperly addressed signals among the control circuitry elements 48 of the control system 100, a microcontroller may monitor the addresses of signals along the master communication bus 110A and the secondary communication bus 110C. In some embodiments, the microcontroller 104B of the primary zone control circuitry 48B may monitor these signals among the control circuitry elements 48 of the control system 100.

As noted above, a control hierarchy among the control circuitry elements may enable each control circuitry element to handle a different subset of responsibilities. A microcontroller 104 monitoring the signals along a communication bus (e.g., 110A, B, C, D, E, F, and/or G) may compare the address of a signal with a plurality of compatible addresses 160 for that respective communication bus (e.g., 110A, B, C, D, E, F, and/or G) stored in a memory 107, a plurality of incompatible addresses 162 for that respective communication bus (e.g., 110A, B, C, D, E, F, and/or G) stored in the memory 107, or both. For example, the microcontroller 104B may allow the transmission of signals addressed to the master control circuitry 48A from the primary zone control circuitry 48B, and the microcontroller 104B may allow the transmission of signals addressed to the primary zone control circuitry 48B from the master control circuitry 48A. Likewise, the microcontroller 104B may allow the transmission of signals addressed to the secondary zone control circuitry 48C from the primary zone control circuitry 48B, and the microcontroller 104B may allow the transmission of signals addressed to the primary zone control circuitry 48B from the secondary zone control circuitry 48C. These allowed signals may be transmitted because they correspond to addresses of the plurality of compatible addresses from the respective control circuitry elements 48. However, the microcontroller 104B may prohibit the transmission of signals addressed to the primary zone control circuitry 48B from the primary zone control circuitry 48B, the microcontroller 104B may prohibit the transmission of signals addressed to the master control circuitry 48A from the master control circuitry 48A or from the secondary zone control circuitry 48C, and the microcontroller 104B may prohibit the transmission of signals addressed to the secondary zone control circuitry 48C from the master control circuitry 48A or from the secondary zone control circuitry 48C. These signals may be prohibited from transmission because they correspond to addresses of the plurality of incompatible addresses for the respective control circuitry elements 48.

In some embodiments, the compatible addresses 160 are specific to one or more control circuitry elements 48 or are specific to one or more communication buses (e.g., 110A, B, C, D, E, F, and/or G). For example, the compatible addresses 160 for the primary zone control circuitry 48B may include the addresses for the master control circuitry 48A and the secondary zone control circuitry 48C, the addresses for the interface devices 114 of one or more zones 146 controlled by the primary zone control circuitry 48B, the addresses for zoning equipment 144 of one or more zones 146 controlled by the primary zone control circuitry 48B, and wireless receivers configured to facilitate communications with one or more wireless sensors of the HVAC system 12 corresponding to the one or more zones 146 controlled by the primary zone control circuitry 48B.

The plurality of incompatible addresses 162 may be specific to one or more control circuitry elements 48 or specific to one or more communication buses 110. For example, the incompatible addresses 162 for the master control circuitry 48A and the master communication bus 110A may include addresses for known incompatible devices such as service tools, HVAC equipment, interface devices, thermostats, or zone sensors. As discussed above, incompatible devices may be legacy devices or mismatched devices that provide lesser and/or different functionalities than devices having compatible addresses 160. Moreover, the incompatible addresses 162 for the secondary communication bus 110C may include the address for the master control circuitry 48A, addresses for indoor devices of the HVAC equipment 116 (e.g., furnace, air handler, energy recovery ventilation control, expansion valve), addresses for outdoor devices of the HVAC equipment 116 (e.g., compressor speed control, compressor stage control). The compatible addresses 160 and incompatible addresses 162 may be stored in the memory 107 of control circuitry 48 at manufacture of the control circuitry 48, at installation of the control circuitry 48, or during subsequent system maintenance.

If the microcontroller 104 identifies a signal with an incompatible address on the master communication bus 110A, the secondary communication bus 110C, or another communication bus (e.g., 110 B, D, E, F, and/or G), then the microcontroller 104 may record the event as an address fault and provide a notification of the address fault. In some embodiments, the microcontroller 104 of control circuitry 48 may query the devices on a communication bus (e.g., 110 A, B, C, D, E, F, and/or G) to identify the addresses of the devices. In some embodiments, a device coupled to a communication bus (e.g., 110 A, B, C, D, E, F, and/or G) may identify, with a signal, its address to the control circuitry 48 coupled to the respective communication bus (e.g., 110 A, B, C, D, E, F, and/or G) when the respective device is installed in the HVAC system 12. The microcontroller 104 may compare the received address for each device to the plurality of compatible addresses 160 for the communication bus (e.g., 110 A, B, C, D, E, F, and/or G) recorded in the memory 107 to determine whether further communications with the respective device are to be allowed. Additionally, or in the alternative, the microcontroller 104 may compare the received address for each device to plurality of incompatible addresses 162 recorded in the memory 107 to determine whether further communications with the respective device are to be prohibited. Identification of an address that is not a compatible address or identification of an incompatible address may cause the microcontroller 104 to record a device incompatibility fault and provide a notification of the incompatibility fault. The device incompatibility fault may be recorded in the fault register 164 and/or the memory 107 of the control circuitry 48 that identified the incompatibility fault.

In some embodiments, the microcontroller 104 may update a fault register 164 to note the fault. In some embodiments, the fault register 164 may note the occurrence of the fault, the incompatible address, the incompatible device, the source that communicated the incompatible address, or any combination thereof. In some embodiments, a time stamp for the fault may also be recorded in the fault register 164. Furthermore, the microcontroller 104 may record the fault in a non-volatile memory, such as the memory 107, for later review by a technician. In some embodiments, the fault may be stored in a fault register 164 and memory 107 of more than one control circuitry element 48. For example, the occurrence of an address fault on the master communication bus 110A may be recorded by the master control circuitry 48A and the primary zone control circuitry 48B.

The faults may be stored in the memory 107 and/or fault register 164 for a predetermined time period, which may be adjusted by a manufacturer or an installer. Additionally, or in the alternative, the fault register 164 or memory 107 may store a predetermined quantity of faults for subsequent review by a manufacturer or technician. In some embodiments, the predetermined quantity of faults may be the most recent 5, 10, or 15 faults. Also, the fault register 164 and/or memory 107 may store each fault for a predetermined time period, such as a month or more. In some embodiments, the predetermined time period may be between 2 weeks to 26 weeks inclusive, 4 weeks to 12 weeks inclusive, or 1 month to 2 months inclusive. In some embodiments, a loss of power to the control circuitry 48 may reset a duration of time for the fault that is compared with the predetermined time period. That is, the control circuitry 48 may set the timestamp for the fault to a time that is after the power interruption dissipates. Storage of the predetermined quantity of faults for the predetermined time period may enable a technician to more easily identify and address the most recent faults of the HVAC system 12. Moreover, the predetermined quantity of faults for the predetermined time period may enable the technician to better prioritize the faults of the control system 100 to be addressed during maintenance.

If the microcontroller 104 identifies a fault, the microcontroller 104 may provide an indication of the fault on one or more displays 166. The one or more displays 166 may include one or more light emitting diodes (LEDs), such as red, green, and amber LEDs that may be used to communicate the type of fault by a predetermined lighting pattern. For example, the type of fault identified by the one or more displays 166 may include an address fault corresponding to a signal with an incompatible system control address on the master communication bus, an address fault corresponding to a signal for the master control circuitry on the secondary communication bus, an address fault corresponding to a signal for indoor equipment of the HVAC equipment on the secondary communication bus, or an address fault corresponding to a signal for outdoor equipment of the HVAC equipment on the secondary communication bus. The one or more displays 166 may include a display screen configured to display text describing the fault. In some embodiments, the one or more displays 166 may cycle through displaying indications of the predetermined number of faults, which may be adjusted by a manufacturer or an installer. For example, the one or more displays 166 may cycle through a display of indications of the last 10 faults. Additionally, or in the alternative, the one or more displays 166 may cycle through a display of indications of faults based on a priority of the faults. In some embodiments, the faults may be displayed via the one or more displays 166 for the predetermined time period, which may be adjusted by a manufacturer or an installer. For example, the one or more displays 166 may display a fault for up to a month or more. The one or more displays 166 may display indications of one or more faults simultaneously. In some embodiments, a cycle through a display of indications of faults may display each fault one at a time without displaying other faults simultaneously. In some embodiments, a loss of power to the control circuitry 48 or the one or more displays 166 may reset a duration of time for the fault that is compared with the predetermined time period. In some embodiments, the fault may be displayed on displays 166 of more than one control circuitry element 48. For example, the occurrence of an address fault on the master communication bus 110A may be displayed by the master control circuitry 48A and the primary zone control circuitry 48B.

In some embodiments, a microcontroller 104 may monitor the communications signals along an external communication bus (e.g., 110 A, B, C, D, E, F, and/or G). The microcontroller 104 may monitor the address of a signal by comparing the address with the plurality of compatible addresses 160 for that respective external communication bus (e.g., 110 A, B, C, D, E, F, and/or G) stored in a memory 107, the plurality of incompatible addresses 162 for that respective communication bus (e.g., 110 A, B, C, D, E, F, and/or G) stored in the memory 107, or both. As discussed above, with FIG. 5, the master control circuitry 48A may communicate with the master interface device 114A and HVAC equipment 116 associated with the vapor compression system 72, the primary zone control circuitry 48B may communicate with a primary interface device 114 and HVAC equipment 116 associated with a first set of building zones 146 (Zones 2-4), and secondary zone control circuitry 48 may communicate with a secondary interface device 114 and HVAC equipment 116 associated with a second set of building zones (Zones 5-8). For this configuration, the microcontroller 104B may monitor the equipment communication bus 110D and allow the master control circuitry 48A to transmit signals with compatible addresses for the master control circuitry 48A, such as signals to the vapor compression system 72, yet the microcontroller 104B may prohibit both the primary zone control circuitry 48B and the secondary zone control circuitry 48C from transmitting signals addressed to devices of the vapor compression system 72. In some embodiments, the microcontroller 104B may monitor the equipment communication bus 110D and allow the control circuitry elements 48A, 48B, 48C to transmit signals to compatible devices of the zoning equipment 144 of the respective zones 146 controlled by the respective control circuitry elements. For example, the master control circuitry 48A may be allowed to transmit, on communication bus 110E, signals to compatibly addressed sensors 142, interface devices 114, and zone dampers 140 of Zone 1. The primary zone control circuitry 48B may be allowed to transmit, on communication bus 110F, signals to compatibly addressed sensors 142, interface devices 114, and zone dampers 140 of Zones 2-4. The secondary zone control circuitry 48C may be allowed to transmit, on communication bus 110G, signals to compatibly addressed sensors 142, interface devices 114, and zone dampers 140 of Zones 5-8. However, the microcontroller 104B may prohibit each control circuitry elements 48 from communicating with devices of the zoning equipment 144 that correspond to other zones 146 because those addresses would be incompatible addresses for the respective communication buses 110.

Figure 10:
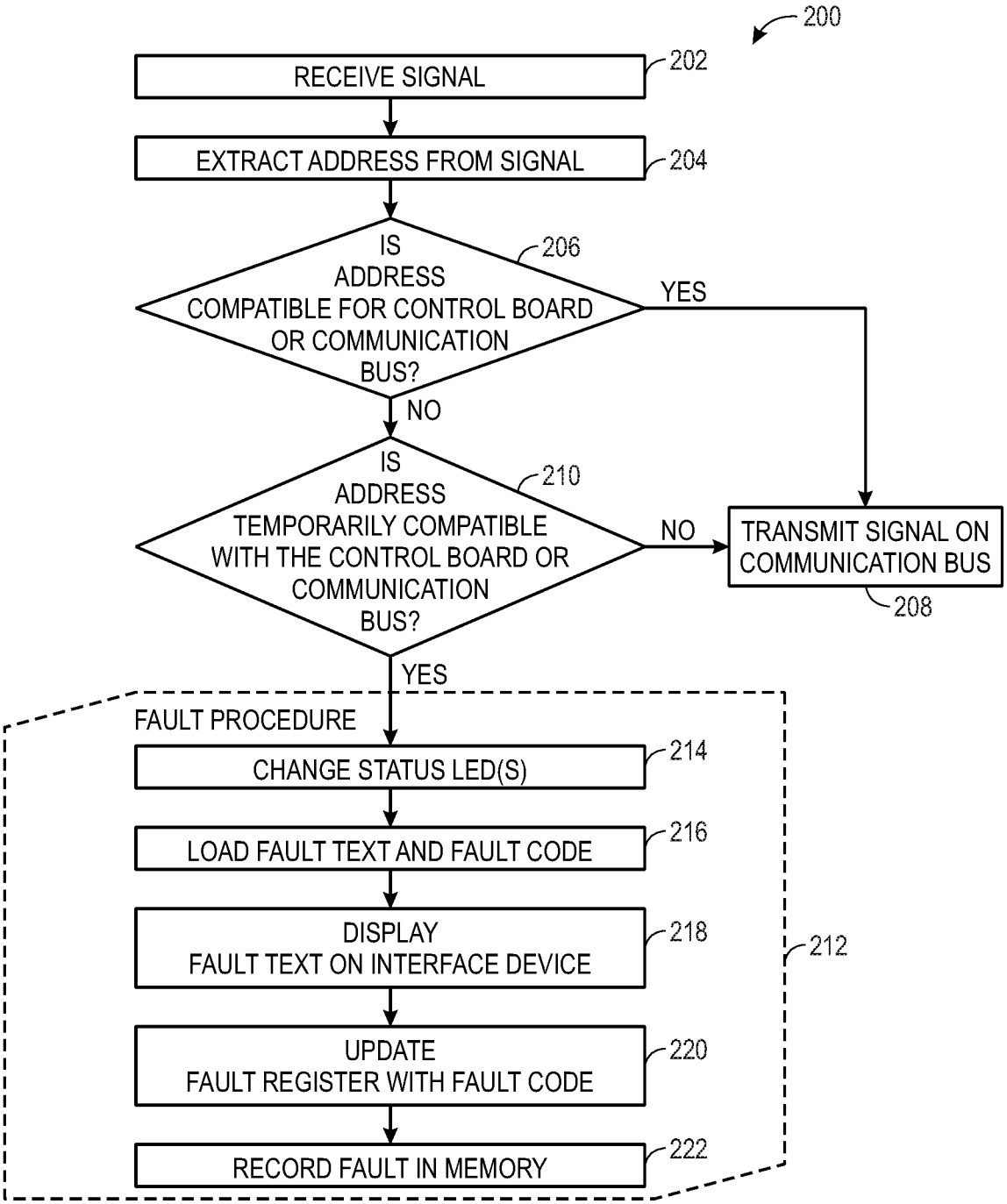
FIG. 10 is a flow diagram of a process for comparing addresses on the communication bus to addresses stored in a memory of the control system, in accordance with an embodiment of the present disclosure.

To help illustrate, an example of a process 200 for monitoring the addresses of signals of the control system 100 of the HVAC system 12 is described with FIG. 10. The process 200 may be implemented on installation or start-up of the control circuitry 48, reset of the control circuitry 48, and/or following any change to the operational status or configuration of devices coupled to the control circuitry 48. Further, although the following description of the process 200 is described in a particular order, which represents a particular embodiment, it should be noted that the process 200 may be performed in any suitable order. Moreover, embodiments of the process 200 may omit process blocks and/or include suitable additional process blocks.

In some embodiments, the process 200 may be implemented at least in part by executing instructions stored in a tangible, non-transitory, computer-readable medium, such as memory 107, using processing circuitry, such as processor 105 of one or more of the control circuitry elements 48. Generally, the process 200 includes receiving a signal on a communication bus from a device that is communicated with a protocol having an address for the sending device or an address for the destination device, as indicated by process block 202. The signal may be received in response to a query by the control circuitry 48, or received while monitoring operations of the control system 100 of the HVAC system 12. The control circuitry 48 receiving the signal may extract one or more addresses from the signal, as indicated by block 204. The control circuitry 48 may compare each extracted address to addresses stored in a memory of the control circuitry, as described above. The decision block 206 illustrates the evaluation of whether the extracted address is a compatible address for the control circuitry 48 and/or the communication bus 110. In some embodiments, an address may be determined to be a compatible address if the address is on a list of compatible addresses for the control circuitry 48 or the communications bus 110. In some embodiments, an address may be determined to be an incompatible address if the address is on a list of incompatible addresses for the control circuitry 48 or the communication bus 110. In some embodiments, an address may be evaluated with a compatible address list and an incompatible address list to determine whether the address may be transmitted by the control circuitry 48 on the communication bus 110. If the extracted address is a compatible address, then the signal may be transmitted on the communication bus, as indicated by block 208. In some embodiments, if the extracted address is not in the plurality of compatible addresses, then the control circuitry 48 may execute instructions for a fault procedure, as described below and indicated with block 212.

The decision block 210 illustrates the comparison of the extracted address to a plurality of temporarily compatible addresses for the control circuitry and/or the communication bus. Some signals with incompatible addresses may be permitted to be transmitted on the communication bus for a temporary communication threshold. While an address fault corresponding to a signal for the master control circuitry on the secondary communication bus may be prohibited from transmission on the communication bus, a signal for a legacy interface device or temperature sensor may be permitted to be transmitted for the temporary communication threshold while a fault procedure is initiated, as indicated by block 212. A temporary communication threshold may be a quantity of transmissions, such as once or twice, or a period of time, such as 1 minute, 5 minutes, 1 day, or 1 week.

An extracted address that is not in the plurality of compatible addresses and/or is in the plurality of incompatible addresses may cause the control circuitry to execute instructions for the fault procedure, as indicated by block 212. The fault procedure may include one or more of the elements discussed above and illustrated in FIG. 10. For example, the control circuitry 48 may provide an indication of an address fault or an incompatibility fault by changing the status of one or more LEDs, as indicated by block 214. The color and/or lighting pattern of the one or more LEDs may be used to communicate the type of fault. In some embodiments, the control circuitry 48 may load fault text and a fault code from memory, as indicated by block 216, and display the fault text on a display of an interface device as indicated by block 218. The control circuitry 48 may update a fault register of the control circuitry 48 with a corresponding fault code, as indicated by block 220. Furthermore as indicated by block 222, the control circuitry 48 may record the fault in memory for review by a technician. As noted above, the memory that records the fault may be a non-volatile memory, thereby enabling review of the fault at a later date despite any power interruptions to the memory.

Along with incompatible hardware faults, other faults may also be tracked and logged. For example, the control circuitry elements 48 of the control system 100 may store multiple faults in the fault registers 164 and/or memories 107A for later review by a technician. Faults stored on control circuitry 48 may be reviewed via the display 166 of the control circuitry 48. In some embodiments, the display 166 of control circuitry may enable the review of faults related to other control circuitry elements. As noted above, the display 166 may display indications of one or more faults simultaneously. In addition to the address faults and incompatibility faults discussed above, the one or more of the control circuitry elements 48 may store other faults that include, but are not limited to, communication faults associated with a communication condition, zone control configuration faults associated with a configuration condition, zone sensor assignment configuration faults, damper power faults associated with a damper power condition, damper fuse faults associated with a damper fuse condition, leaving air sensor faults associated with a leaving air sensor condition, leaving air sensor temperature faults associated with a leaving air temperature condition, low voltage faults associated with a voltage condition, and airflow faults associated with an airflow condition. Each fault may be identified by a respective fault code that facilitates storage on the control circuitry 48. The fault code and/or fault text that explains the fault code may be displayed on the display 166 of the control circuitry 48.

A communication fault may be stored when a control circuitry element is unable to communicate with another device of the HVAC system for a communication timeout period, such as 30 seconds or more. For example, a primary zone control fault may be stored by the master control circuitry 48A or by the secondary zone control circuitry 48C if the respective control circuitry 48 does not receive valid signals from the primary zone control circuitry 48B for the communication timeout period. A secondary zone communication fault may be stored on the primary zone control circuitry 48B if the primary zone control circuitry 48B does not receive valid signals from the secondary zone control circuitry 48C for the communication timeout period. An HVAC master communication fault may be stored on the primary zone control circuitry 48B if the primary zone control circuitry 48B does not receive valid signals from the master control circuitry 48A for the communication timeout period. An interface device communication fault may be stored on control circuitry element 48 if the respective control circuitry element 48 corresponding to an interface device does not receive valid signals from the interface device for the communication timeout period. In some embodiments, the communication fault may be cleared by a manual input upon restoration of communications between the respective devices.

A zone control configuration fault may be stored on one or more control circuitry elements 48 of the control system 100 if the primary zone control circuitry 48B and the secondary zone control circuitry 48C utilize the same address and/or neither utilizes the address designated for the secondary zone control circuitry. The zone control configuration fault may be cleared by a manual input by updating the address of the secondary zone control circuitry 48C to the compatible address. A zone sensor assignment configuration fault may be stored on the primary zone control circuitry 48B if a zone sensor is not assigned to a zone of the building. The zone sensor assignment configuration fault may be cleared by a manual input upon assigning the zone sensor to one of the zones.

A damper fuse fault may be stored on control circuitry 48 of the control system 100 if the respective control circuitry identifies a damaged fuse for a damper power circuit of the respective control circuitry. For example, a blown fuse of a damper power circuit coupled to the primary zone control circuitry 48B may store a damper fuse fault on the primary zone control circuitry 48B. A damper power fault may be stored on control circuitry 48 of the control system 100 if the respective control circuitry identifies a prolonged drop in a voltage of the damper power circuit of the respective control circuitry. For example, with a damper power circuit coupled to the secondary zone control circuitry 48C, a voltage drop below a threshold voltage value (e.g., 16 VAC) for a low voltage period (e.g., 125 mS) may store a damper power fault on the secondary zone control circuitry 48C. The damper fuse fault may be cleared by a manual input upon replacement of the damaged fuse, and the damper power fault may be cleared by a manual input upon supply of voltage above the threshold voltage value to the damper power circuit.

A leaving air sensor may be configured to measure a property of an airflow downstream of equipment of the HVAC system. A leaving air sensor fault may be stored on control circuitry 48 of the control system 100 if the respective control circuitry identifies a short-circuit condition or an open circuit condition of a leaving air sensor coupled to the control circuitry 48 for greater than an LAS fault period. For example, the measured properties may include, but are not limited to temperature, pressure, flow rate, humidity, or any combination thereof. The leaving air sensor fault may be cleared by a manual input upon correction of the short-circuit condition or open circuit condition, such as via replacement of the leaving air sensor. A leaving air sensor temperature fault may be stored on control circuitry 48 coupled to a leaving air sensor that measures a temperature that is outside of a temperature range for an LAS temperature fault period. For example, a leaving air temperature fault may be stored if the HVAC system is operating in a cooling mode and the leaving air temperature is less than a low temperature limit for the LAS temperature fault period (e.g., 30 seconds). A leaving air temperature fault may be stored if the HVAC system is operating in a heating mode and the leaving air temperature is greater than a high temperature limit for the LAS temperature fault period. It may be appreciated that the high temperature limit may be based at least in part on the type of HVAC heating equipment, such as a heat pump or a furnace. In some embodiments, the primary zone control circuitry 48B may communicate with the master control circuitry 48A in response to a leaving air temperature fault to instruct one or more devices of the HVAC equipment 116 to stop for a minimum off period, thereby enabling the temperature measured by the leaving air sensor to adjust to a temperature within the temperature range. In some embodiments, the leaving air sensor temperature fault may be cleared by a manual input when the leaving air temperature is within the temperature range for an LAS temperature clearing period (e.g., 300 seconds).

A low voltage fault may be stored on control circuitry 48 of the control system 100 if the respective control circuitry 48 identifies that the voltage supplied to the control circuitry 48 is less than one or more low voltage thresholds for the low voltage period. In some embodiments, a first low voltage fault triggered at a first low voltage threshold may not affect the operations of the control circuitry, yet a second low voltage fault triggered at a second low voltage threshold less than the first low voltage threshold may cause the control circuitry to adjust damper outputs to a startup or default position. This adjustment of the damper outputs in response to the second low voltage fault may enable the control circuitry to reduce or eliminate any effects of the second low voltage fault on the supply of conditioned air to the building. The low voltage faults may be cleared by a manual input when the monitored voltage supplied to the control circuitry upon supply of voltage above the threshold voltage.

An airflow fault may be stored on control circuitry 48 of the control system 100 if the respective control circuitry identifies an airflow condition or a target airflow setting that is outside of a threshold airflow range. For example, a zone airflow fault may be stored on the primary zone control circuitry 48B if the airflow condition or airflow setting for a zone is less than a zone minimum threshold (e.g. 400 CFM). A system minimum airflow fault may be stored on the primary zone control circuitry 48B if a sum of the airflow settings (e.g., target airflows) for the zones of the building is less than a minimum airflow provided by the HVAC system 12. A system maximum airflow fault may be stored on the primary zone control circuitry 48B if a sum of the airflow settings (e.g., target airflows) for the zones of the building is greater than an upper threshold (e.g., 150%) of a predefined maximum airflow setting provided by the HVAC system 12. The airflow faults may be cleared by a manual input when the airflow settings for the one or more zones of the building are within the respective threshold airflow ranges.

Faults identified by control circuitry 48 of the control system 100 may be stored in the respective fault register 164 and/or memory 107 of the respective control circuitry 48. In some embodiments, one of the control circuitry elements 48 may access, via the communication bus 110, the faults stored in the fault register 164 or memory 107 of another control circuit element 48 of the control system 100. Each fault may have an assigned priority. In some embodiments, the assigned priority is based on how the fault may affect the control system 100. For example, the faults may be prioritized in the following descending order of priority: communication faults, zone control configuration fault, damper fuse fault, damper power fault, leaving air sensor fault, leaving air sensor temperature fault, low voltage fault, and airflow fault. Moreover, faults may be prioritized based on the respective control circuitry affected by the fault, with faults associated with the master control circuitry 48A having a greater priority than faults associated with the secondary zone control circuitry 48C. Each fault may include a time stamp indicating when the fault occurred.

In some embodiments with finite storage for faults, older faults and/or faults with a lesser priority may be cleared to enable more recent faults and/or faults with a greater priority to be stored. For example, a memory 107 of control circuitry 48 may store 10, 15, 20, 50, or 100 faults. The time stamps of each fault may enable the one or more displays 166 of a control circuitry element 48 to display the most recent one or more faults. Through review of the most recent faults, a technician may timely resolve the most recent faults before addressing less recent faults. In some embodiments, each fault may be stored on control circuitry 48 for a month before the control circuitry 48 automatically clears the fault. As may be appreciated, a fault may be stored again shortly after it was automatically cleared if the underlying condition that caused the initial fault remains. Accordingly, automatically clearing faults after a predetermined time period may improve the ability of a technician to resolve the most recent faults. Furthermore, automatically clearing faults after the predetermined time period may enable the technician to ignore faults that may not have been otherwise cleared despite a prior resolution of the underlying condition that caused the initial fault. In some embodiments, a power interruption to the control circuitry 48 storing a fault may reset a duration of time for the fault that is compared with the predetermined time period, thereby extending the time that the fault is stored on the control circuitry 48.

Figure 11:
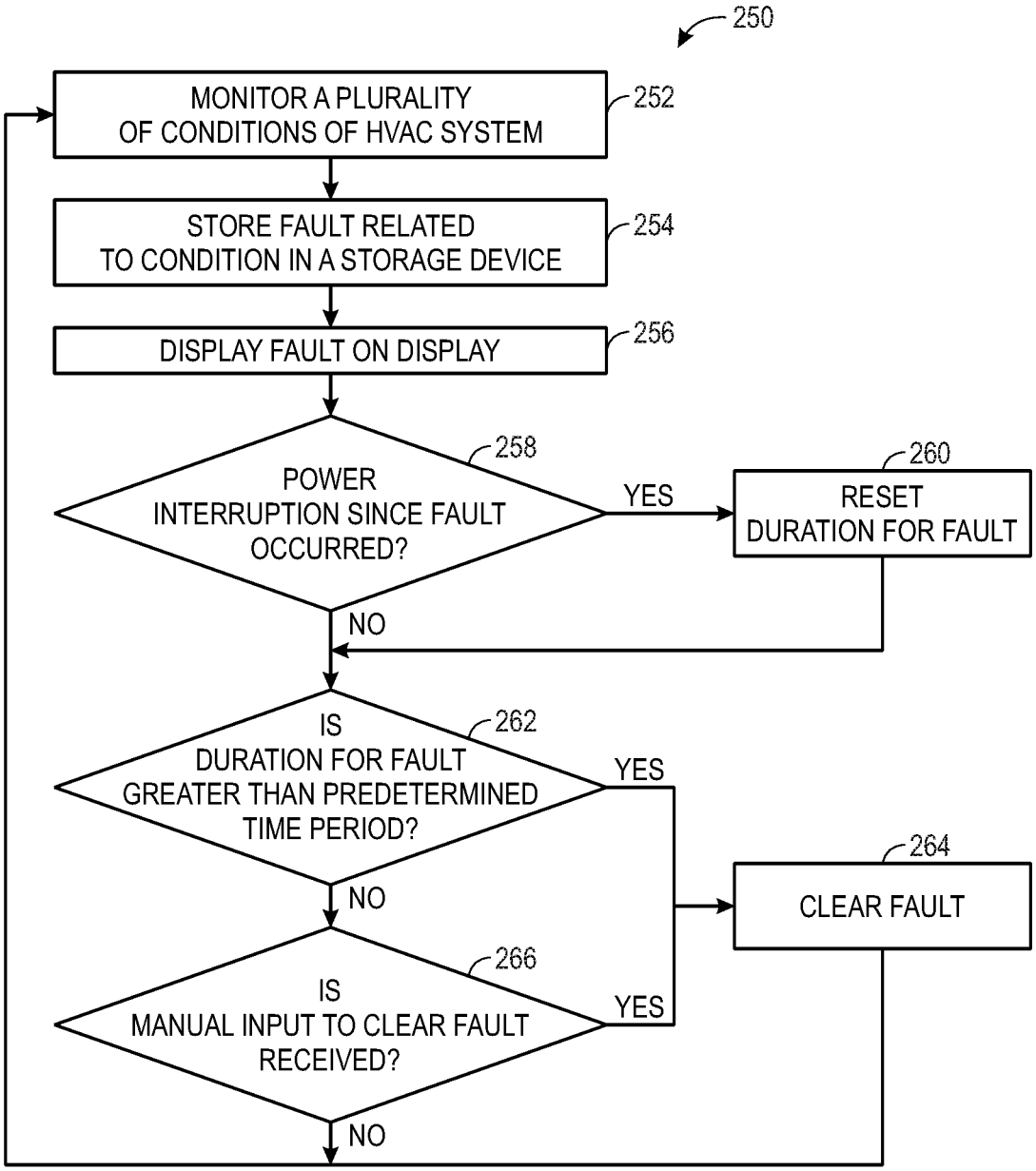
FIG. 11 is a flow diagram for a process for monitoring the control system of the HVAC system and handling faults identified on the control system, in accordance with an embodiment of the present disclosure.

FIG. 11 illustrates a process 250 for monitoring the control system 100 of the HVAC system 12 and handling faults stored in a storage device of the control system 100. As discussed above, control circuitry may monitor a plurality of signals and circuits of the control system to monitor conditions of the HVAC system, as indicated by block 252. For example, some faults might include address faults, incompatibility faults, communication faults, zone control configuration faults, zone sensor assignment configuration faults, damper power faults, damper fuse faults, leaving air sensor faults, leaving air sensor temperature faults, low voltage faults, and airflow faults.

When a fault is observed related to a monitored condition, the fault may be stored in a storage device, as indicated by block 254. In some embodiments, a representation of the fault may be displayed on a display, as indicated by block 256. The representation of the fault on the display may be a fault code, fault text that explains the fault code, a priority of the fault, a time stamp of the fault, or any combination thereof. In some embodiments, indications of one or more of the faults stored in the storage device may be displayed on the display in a cycle. Furthermore, the storage device with the one or more faults displayed on the display may be coupled to the same control circuitry or a different control circuitry element that is coupled to the display. That is, the control circuitry may communicate one or more faults along the communication buses described above to facilitate the display of faults for a technician.

As mentioned above, a duration since the fault was stored may be tracked, indicating a recency of the fault. In some instances, a power outage may result in reduced time to manage faults and/or may indicate particularly problematic faults. Accordingly, a microcontroller for control circuitry may determine whether there was a power interruption for the control circuitry since the occurrence of each fault stored in the storage device, as indicated by decision block 258. If there was a power interruption, then the duration of time for the fault will be reset, as indicated by block 260, enabling additional time for analysis of the fault.

The duration for the fault since the occurrence of the fault or since the reset will be compared to a predetermined threshold time period, as indicated by decision block 262. If the duration is greater than the predetermined threshold time period, such as a month, then the fault will be cleared, as indicated by block 264. That is, the fault may be cleared based on the duration of the fault regardless of whether the underlying issue that cause the fault has been addressed.

If the duration is not greater than the predetermined time period, then the fault may be cleared by a manual input received by the control circuitry to clear the fault, as indicated by decision block 266. After determining at decision blocks 262 and 266 whether the fault is to be cleared, the process 250 may be repeated to monitor the control system 100 of the HVAC system 12. In some embodiments, the process 250 may be executed automatically, such as at the occurrence of a fault or after a fault monitoring period (e.g., 5, 15, 60 minutes), or executed manually, such as on-demand in response to an input to the control circuitry 48.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. A control system for a heating, ventilation, and/or air conditioning (HVAC) system comprising control circuitry, the control circuitry comprising:

a memory configured to store faults; and a microcontroller configured to:

monitor for a condition of the HVAC system associated with a fault;

store the fault in the memory when the condition is detected;

identify whether a duration of time that the fault has been stored in the memory exceeds a threshold time period;

reset the duration of time that the fault has been stored in the memory after occurrence of a power interruption of the control circuitry; and clear the fault from the memory when the duration of time exceeds the threshold time period.

2. The control system of claim 1, wherein the microcontroller is configured to:

store the fault with a time stamp indicative of when the fault was added to the memory; and display an indication of the fault based on the time stamp.

3. The control system of claim 1, comprising a display, wherein the microcontroller is coupled to the display and is configured to control the display to display an indication of the fault when the fault is stored in the memory.

4. The control system of claim 1, wherein the fault is a first fault, the condition is a first condition, the duration of time is a first duration of time, and the microcontroller is configured to:

monitor a second condition of the HVAC system associated with a second fault;

store the second fault in the memory when the second condition is detected;

identify whether a second duration of time that the second fault has been stored in the memory exceeds the threshold time period;

reset the second duration of time that the second fault has been stored in the memory after occurrence of the power interruption of the control circuitry; and clear the second fault from the memory when the second duration of time exceeds the threshold time period.

5. The control system of claim 4, wherein the microcontroller is configured to:

prioritize the first fault with a first priority based on the first condition;

prioritize the second fault with a second priority based on the second condition, wherein the second priority is less than the first priority; and prioritize display of a first indication of the first fault on a display coupled to the microcontroller over display of a second indication of the second fault on the display based on the second priority being less than the first priority.

6. The control system of claim 1, comprising a display, wherein the microcontroller is coupled to the display and is configured to control the display to cycle through, one at a time, indications of faults in an order based on a respective fault time stamp of each fault.

7. The control system of claim 1, wherein the memory comprises a fault register and a non-volatile memory.

8. The control system of claim 1, wherein the fault comprises a communication fault associated with a communication condition, a zone control configuration fault associated with a configuration condition, a damper fuse fault associated with a damper fuse condition, a damper power fault associated with a damper power condition, a leaving air sensor fault associated with a leaving air sensor condition, a leaving air sensor temperature fault associated with a leaving air temperature condition, a low voltage fault associated with a voltage condition, or an airflow fault associated with an airflow condition.

9. The control system of claim 8, comprising a display, wherein the microcontroller is coupled to the display and is configured to:

control the display to display a cycle of indications of faults based on an order of priority of each fault stored in the memory; and prioritize faults as follows: communication faults before zone control configuration faults, zone control configuration faults before damper fuse faults, damper fuse faults before damper power faults, and then the damper power faults.

10. The control system of claim 1, wherein the microcontroller is configured to:

receive a manual input to clear the fault; and clear the fault from the memory in response to the manual input.

11. The control system of claim 1, wherein the threshold time period comprises at least one month.

12. The control system of claim 1, wherein the microcontroller is configured to:

receive a manual input requesting an adjustment to the threshold time period; and adjust the threshold time period in response to the manual input requesting the adjustment.

13. The control system of claim 1, wherein the microcontroller is configured to:

store a plurality of faults in the memory, wherein each fault of the plurality of faults is stored with a respective timestamp indicative of when the respective fault was added to the memory;

identify a quantity of the plurality of faults stored in the memory;

identify an oldest fault of the plurality of faults based on a comparison of the respective timestamp of each fault of the plurality of faults; and clear the oldest fault of the plurality of faults from the memory in response to detecting the condition associated with the fault if the quantity of the plurality of faults exceeds a threshold quantity of faults to be stored by the memory.

14. A control system for a heating, ventilation, and/or air conditioning (HVAC) system comprising control circuitry, the control circuitry comprising:

a memory configured to store faults;

a display; and a microcontroller configured to:

store a fault in the memory;

display an indication of the fault on the display, wherein the indication comprises a duration of time that the fault has been stored in the memory;

reset the duration of time that the fault has been stored in the memory in response to identification of an occurrence of a power interruption of the control circuitry;

identify a threshold time period to retain storage of the fault in the memory; and clear the fault from the memory when the duration exceeds the threshold time period.

15. The control system of claim 14, wherein the microcontroller is configured to:

receive a manual input to clear the fault; and clear the fault from the memory in response to the manual input.

16. A tangible, non-transitory, computer-readable medium, comprising computer-readable instructions executable by at least one processor of a control system in a heating, ventilation, and/or air conditioning (HVAC) system that, when executed by the at least one processor, cause the at least one processor to:

monitor for occurrence of a condition of the HVAC system;

store, upon detecting the occurrence of the condition, a fault in a non-volatile memory, wherein the fault provides an indication of the condition;

monitor a duration of time that the fault has been stored in the non-volatile memory;

identify a power interruption to the at least one processor of the control system;

reset the duration of time based upon the power interruption;

identify whether the duration of time exceeds a defined threshold time period; and clear the fault when the duration of time exceeds the defined threshold time period.

17. The computer-readable medium of claim 16, comprising computer-readable instructions that, when executed by the at least one processor, cause the at least one processor to:

receive a manual input to clear the fault; and clear the fault from the non-volatile memory in response to the manual input.

18. The computer-readable medium of claim 16, comprising computer-readable instructions that, when executed by the at least one processor, cause the at least one processor to display a cycle of indications of a plurality of faults stored in the non-volatile memory, wherein the plurality of faults comprises the fault corresponding to the condition, wherein the cycle of indications of faults comprises a fault time stamp, a fault code, or a fault priority of the respective fault of the plurality of faults.

19. The computer-readable medium of claim 16, comprising computer-readable instructions that, when executed by the at least one processor, cause the at least one processor to prioritize display of a priority fault of a plurality of faults, on a display, based at least in part on a greater fault priority of the priority fault relative to other faults of the plurality of faults.

20. The computer-readable medium of claim 16, comprising computer-readable instructions that, when executed by the at least one processor, cause the at least one processor to:

identify a recent fault that has been stored within a recent threshold time period; and display an indication of the recent fault on a display based at least in part on being stored within the recent threshold time period.

21. The computer-readable medium of claim 16, comprising computer-readable instructions that, when executed by the at least one processor, cause the at least one processor to:

reset the duration of time, by:

storing the fault with a fault time stamp indicative of when the fault is stored in the non-volatile memory; and resetting the fault time stamp of the fault in response to the power interruption to the at least one processor.

22. The computer-readable medium of claim 16, comprising computer-readable instructions that cause the at least one processor to:

identify a maximum allowable quantity of faults allowed to be stored in the non-volatile memory;

identify an overflow condition that adding the fault to the non-volatile memory would exceed the maximum allowable quantity of faults;

in response to identifying the overflow condition:

identify an oldest fault stored in the non-volatile memory;

clear the oldest fault from the non-volatile memory; and store in the non-volatile memory the fault that corresponds to the condition.

* * * * *